United States Patent [19]

Lucas

[11] 4,041,711

[45] Aug. 16, 1977

[54] METHOD AND APPARATUS FOR QUICKLY ERECTING OFF-SHORE PLATFORMS

[75] Inventor: Joseph E. Lucas, Caracas, Venezuela

[73] Assignee: Marine Engineering Co., C.A., Caracus, Venezuela

[21] Appl. No.: 543,350

[22] Filed: Jan. 23, 1976

Related U.S. Application Data

[62] Division of Ser. No. 353,665, April 23, 1973, Pat. No. 3,876,181.

[51] Int. Cl.[2] ..... E02B 17/04; B66F 1/00

[52] U.S. Cl. ..... 61/91; 61/93; 254/89 H; 254/105

[58] Field of Search ..... 61/46.5; 254/105, 106, 254/89 H; 9/8

[56] References Cited

U.S. PATENT DOCUMENTS

| | | | |
|---|---|---|---|
| 3,001,592 | 9/1961 | Lucas | 61/46.5 X |
| 3,429,127 | 2/1969 | Donkers | 61/46.5 |
| 3,524,322 | 8/1970 | Pogonowski | 61/46.5 |
| 3,556,480 | 1/1971 | Johansson | 254/89 H |
| 3,833,118 | 5/1958 | Nixon | 61/46.5 |

*Primary Examiner*—Jacob Shapiro

*Attorney, Agent, or Firm*—Fitzpatrick, Cella, Harper & Scinto

[57] ABSTRACT

Method and apparatus for elevating an off-shore well drilling or other platform on a support structure in a minimum of time with maximum safety. The platforms are elevated on one or more caissons, utilizing one or more jacking units.

One type of support structure comprises three caissons arranged as a tripod. The platform to be mounted thereon has three open caisson wells and is floated into position, with one caisson received in each well. A caisson locking gate is closed to hold the platform in place. A pre-set-up jacking unit is located near or straddles each caisson well. Each jacking unit includes a jacking head, one or more jacking legs pivotally connected at their upper end to the jacking head, and a jacking mechanism surrounding each jacking leg and connected by a gimbal joint at its lower end to the platform. A stabilizing frame for each jacking unit is mounted on the platform. Trolleys mounted on the opposite sides of the frame, pulleys and tensioned cables initially hold the jacking head centered in the frame. Additional cables hold the jacking head suspended above the upper end of its associated caisson, ready to be lowered onto the caisson to immediately commence the platform hoisting operation.

29 Claims, 31 Drawing Figures

Fig. 11.
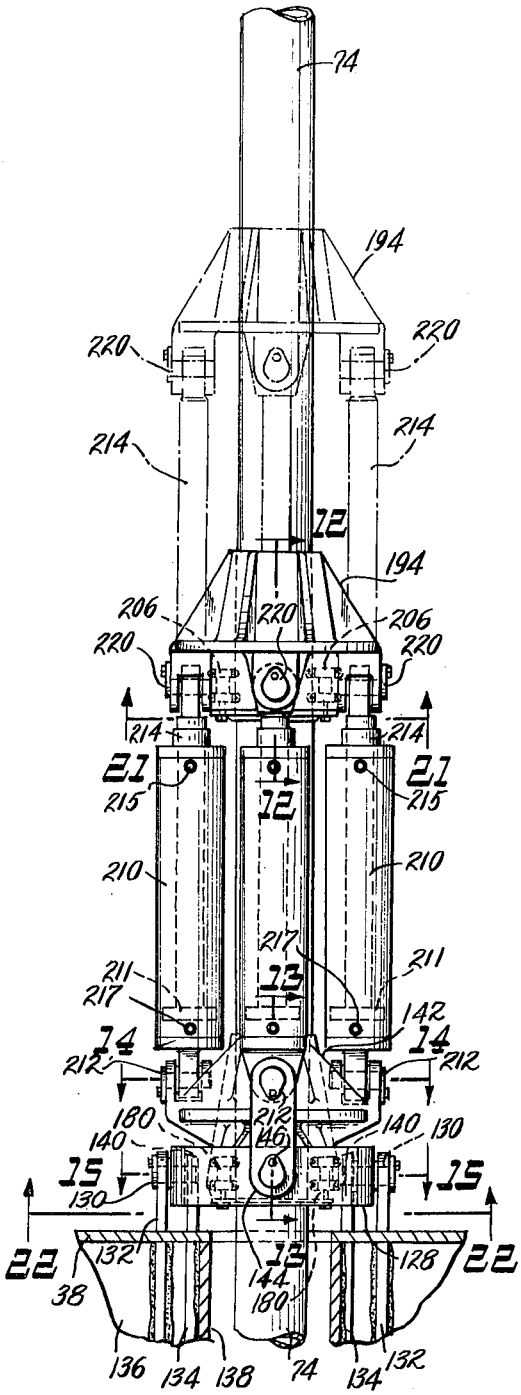
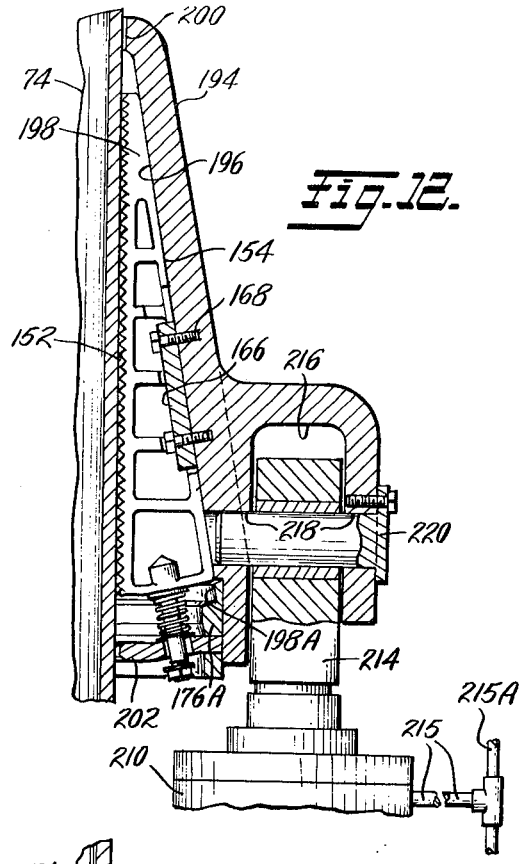
Fig. 12.
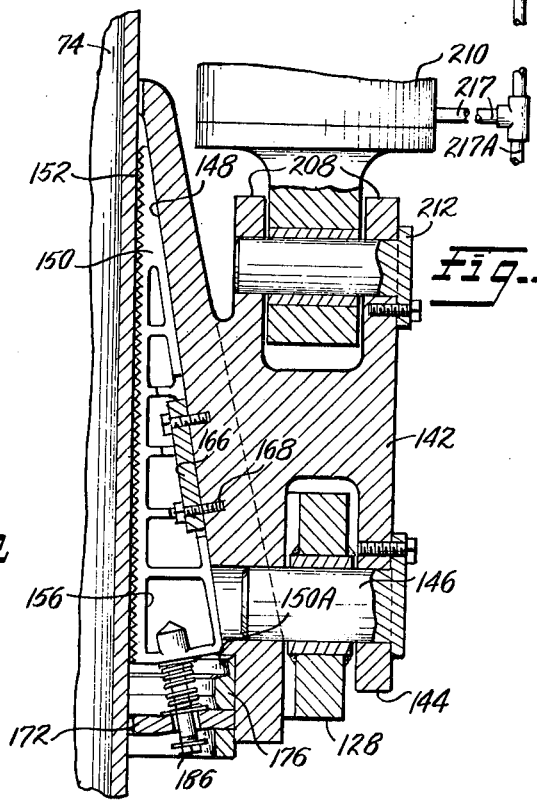
Fig. 13.

Fig. 19.
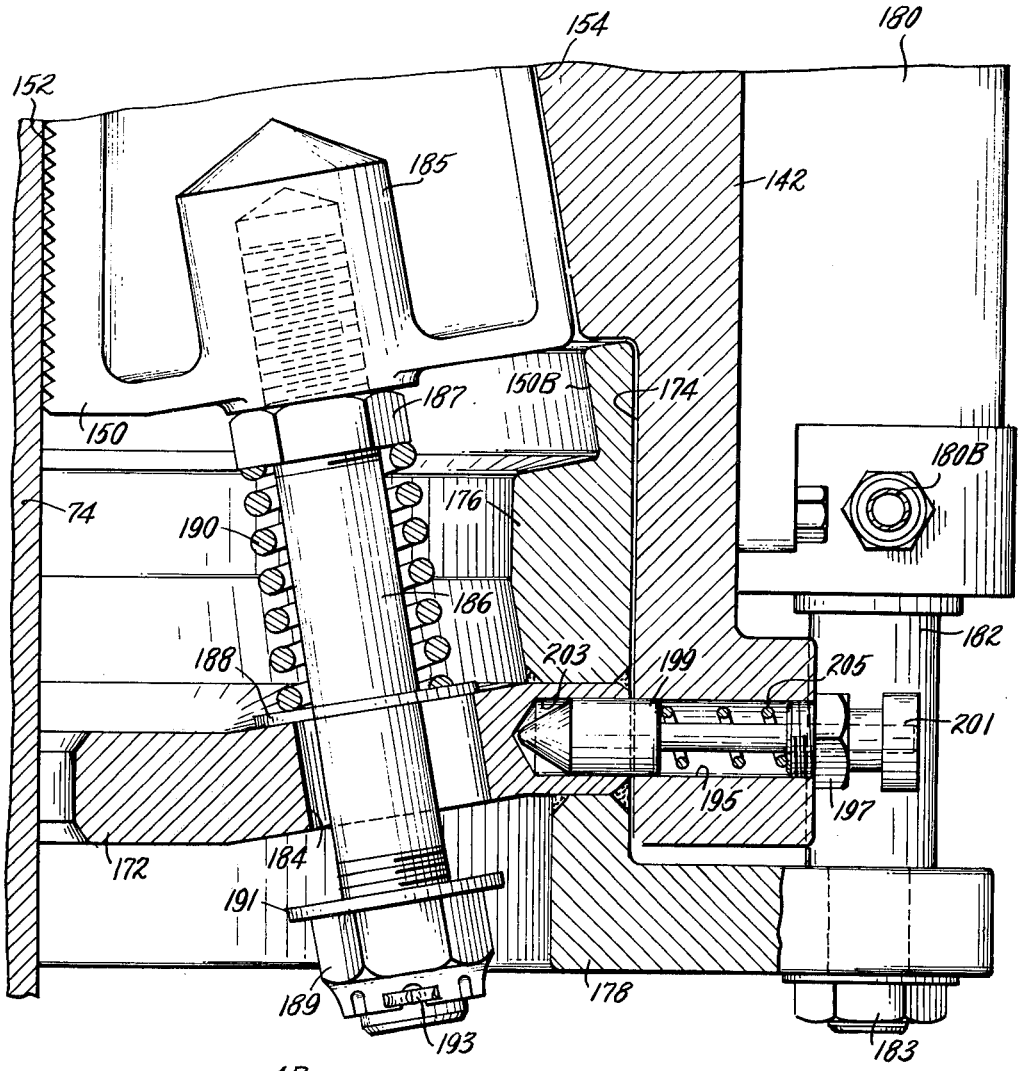
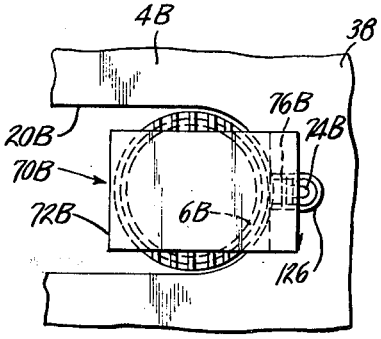
Fig. 27.
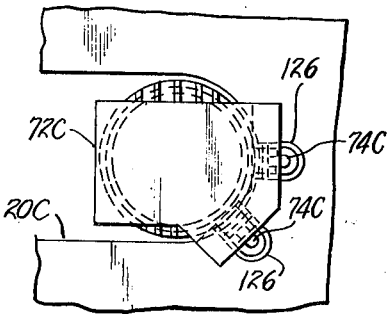
Fig. 28.

Fig. 20.
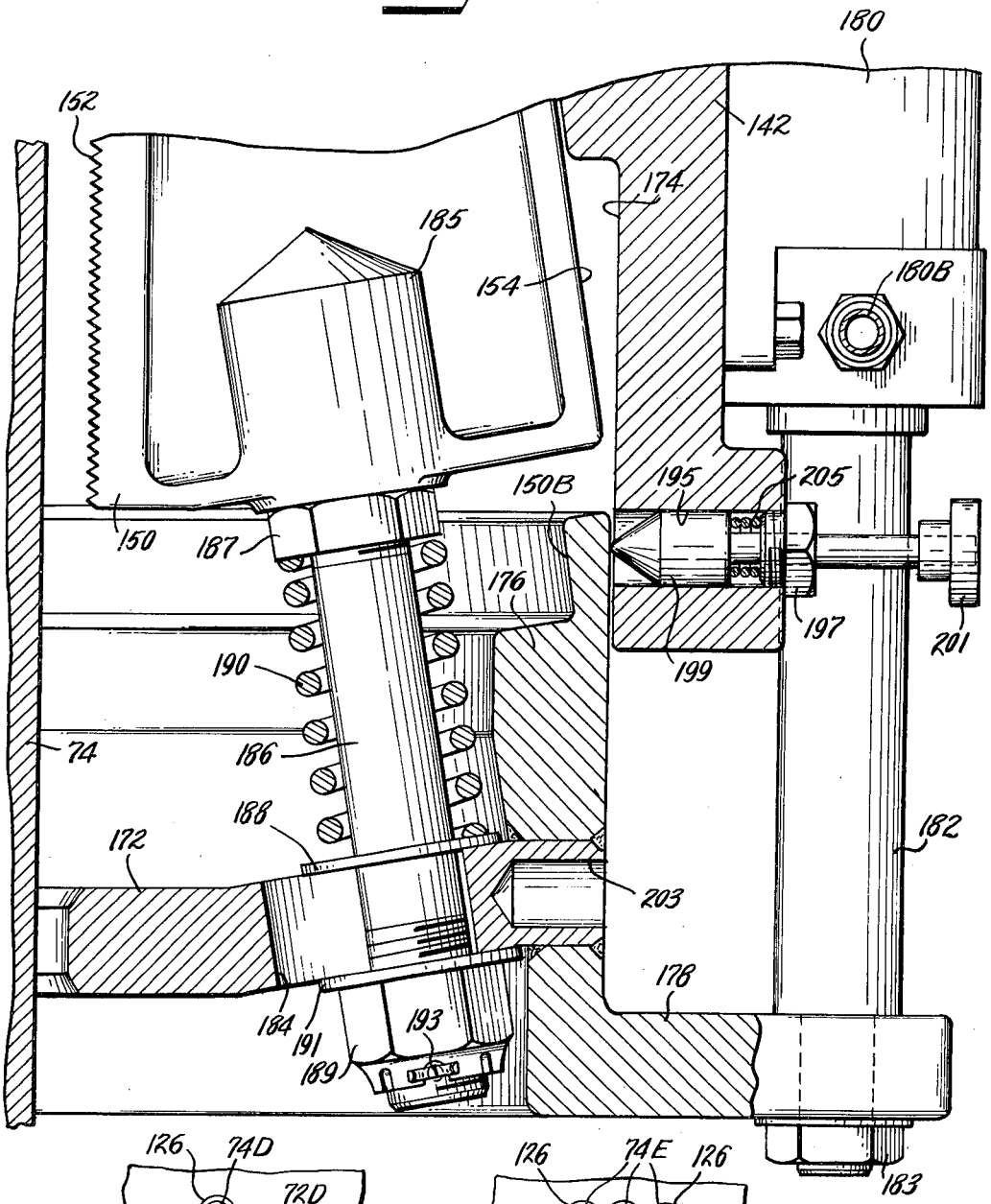
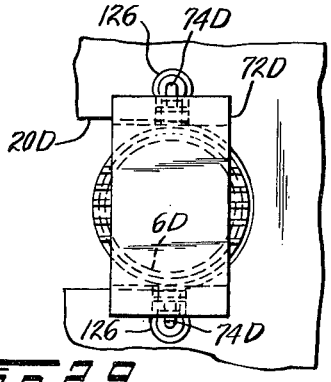
Fig. 29.
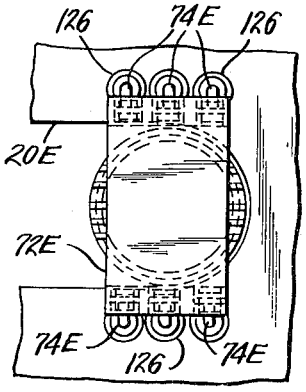
Fig. 30.

Fig. 21.
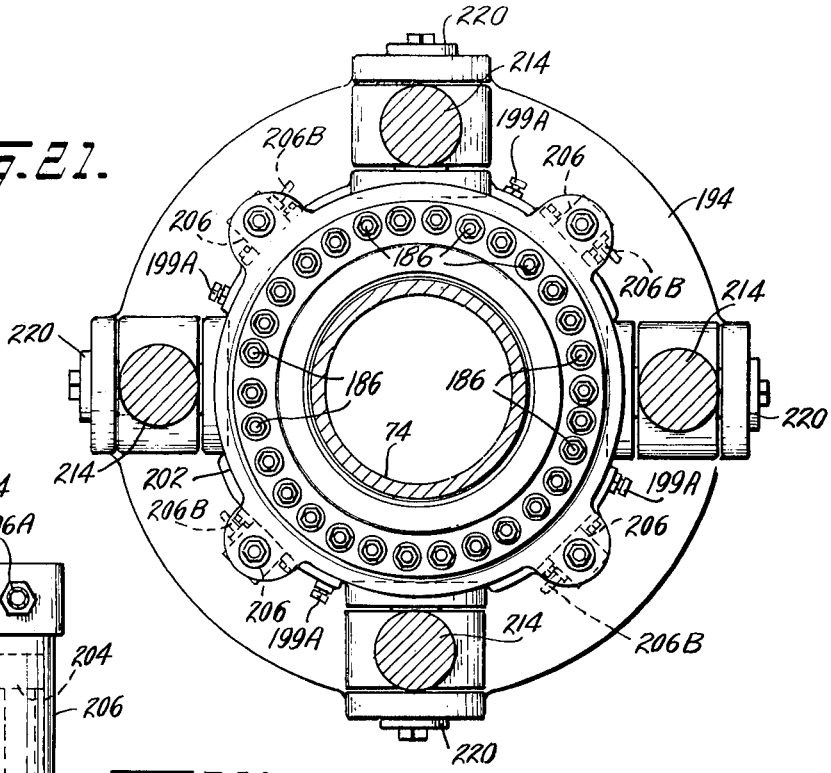
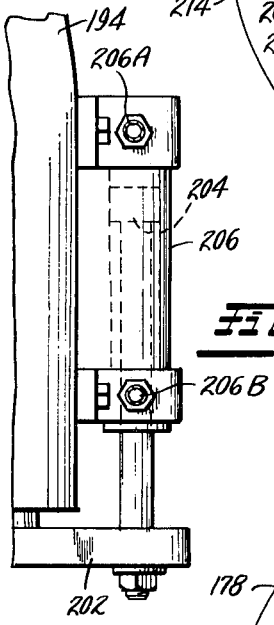
Fig. 21A.
Fig. 22.
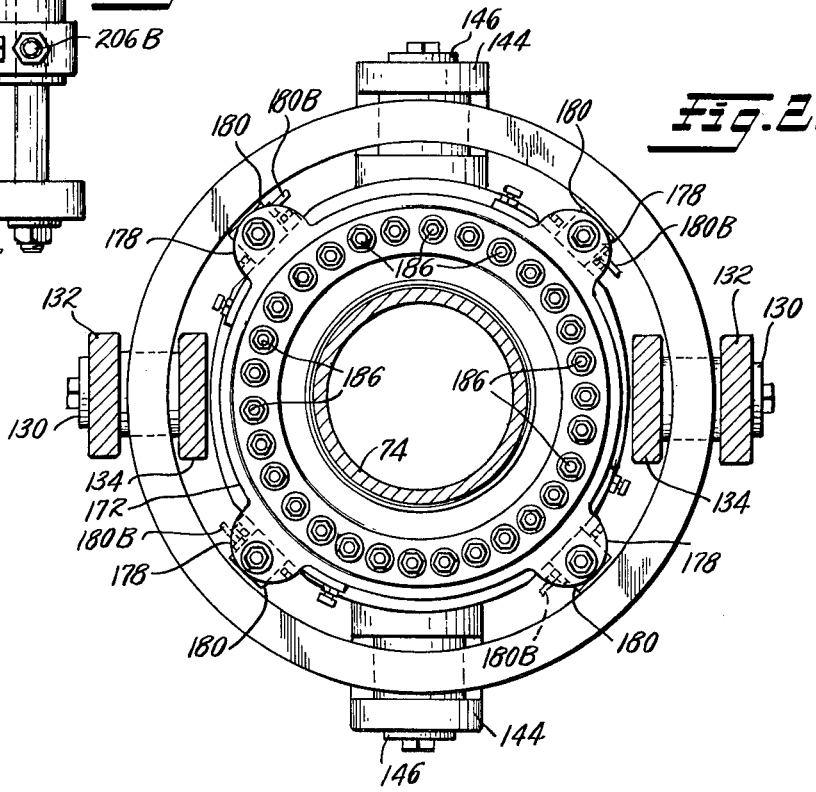

56
68
26
118
116
120
70B
72B
76B
74B
86B
6B
58
60
126
112
4B
38
20B
104
106
102
100
114
238
222

METHOD AND APPARATUS FOR QUICKLY ERECTING OFF-SHORE PLATFORMS

This is a division of application Ser. No. 353,665 filed Apr. 23, 1973, now U.S. Pat. No. 3,876,181.

BACKGROUND OF THE INVENTION

1. Field of the Invention

This invention relates to off-shore well drilling and related equipment and, more particularly, to prefabricated drilling and production and other platforms, and prefabricated tripod and monopod support structures for maintaining the platforms at a desired elevation above the water, the platforms being buoyant and maneuverable into position relative to the supports and being provided with pre-set-up jacking means immediately operable to raise the platforms on the supports to the desired height above the water after the platforms have been moved into place.

2. Description of the Prior Art

Prefabricated drilling and production platforms and supports therefor, and jacking mechanisms for raising the platforms on the supports have been devised heretofore, but many of these are suitable only for use in shallow and relatively calm waters. Some of such prior platforms have utilized jacking mechanisms including racks and pinions with the racks attached to square spuds, but these have the disadvantage that the spuds must be pre-mounted in openings in the platform and the racks indexed with pinions mounted on the platform, so that proper engagement can be effected. Such structure is shown in Bulkley et al U.S. Pat. No. 2,308,743. Racks and pinions when applied to caissons have the further disadvantage that pressure loads are applied to local areas, which may cause collapse, or require excessive and undesirable internal bracing of the caissons. The latter is particularly objectionable when conductor pipes are to be located in the caissons.

Other prior jacking devices include annular rubber tubelike elements carried by the barge or platform and surrounding the caissons. A jack of this type is disclosed in Suderow U.S. Pat. No. 2,948,119. The rubber elements must be inflated by air to grip the caissons, and manipulated to elevate the barge on the caissons. Such devices are objectionable because the rubber elements are subject to rapid wear, blow out, require substantial maintenance and frequent replacement. Furthermore, they have a tendency to slip relative to the caissons, particularly if the exterior surface of the caissons is contaminated by oil, algae, or mud. Such devices are subject to failure by allowing the barge to drop back onto the water whenever the air supply fails, as by the rupture of an air hose.

Still another jacking device, known as a cable jack, includes criss-crossed cables that are operable for positively gripping the exterior of the caissons and raising the barge on the caissons. Such jack is disclosed in my prior U.S. Pat. No. 2,858,105. The cable jacks are much more satisfactory than the rack and pinion type jack and inflatable rubber tube device. However, all of the foregoing types of jacking devices have the disadvantage that they are slow in operation and take considerable time to "set up" and to be operated to effect elevation of the barge to the desired working height. Such slow-operating jacking devices are unsuitable for use in rough waters, and particularly in areas subject to abnormally high changes in tide levels, say, 20 to 30 feet, or to high waves because of the potential damage to either the caissons or the barge, or both, during the period that the barge is subject to movement by wave action. The hazards, of course, are less after the barge has been raised above wave level effect, but with slow-operating jacking devices it may take several hours' time to do this.

Another prior jacking apparatus, shown in Nixon U.S. Pat. No. 2,833,118, embodies the use of four sets of cables on each caisson, the cables being under tension and fastened at their opposite ends to the exterior of the caisson. A wedge type jacking mechanism is associated with each set of cables and is fixed to the barge or platform. The caissons are pre-positioned in openings in the barge. The jacking mechanisms are designed to lower the caissons to the bottom and then elevate the barge. They can be used later to raise the caissons to enable the barge to be moved to another site. Such device has the objections that the cables become worn and frayed with repeated use; the caissons must be mounted in the platform before it is towed to the site or else must time is wasted in setting them up at the site; the caissons rise and fall with the barge in response to wave action; and it is possible for the barge to lift the caissons off the bottom at any time during the jacking operation until the barge is raised high enough to be clear of the waves. This makes it difficult to locate the barge at an exact point and could result in damage to the barge and/or caissons and injury to personnel.

A prefabricated platform support structure, including a tripod that is towed to the drilling site and sunk, is not new per se. A structure of this type is disclosed in the patent to Kuss et al, U.S. Pat. No. 2,586,966. However, the patentees contemplate building a platform on the caissons after the support has been anchored to the bed of the ocean. Such procedure is objectionable because it is expensive, slow, impractical, and very hazardous. Considerable auxiliary equipment is required in the way of tugs and lighters to bring the platform components to the site, and derrick barges are required for use in erecting the components on the caissons. Obviously, no erection work can be done in rough seas, at which time all personnel and rented equipment remains idle at tremendous costs.

A prefabricated platform with three caisson wells has heretofore been used with a prefabricated tripod support in constructing a structure known as Texas Tower No. 4. Jacking devices somewhat similar to the cable jacks disclosed in the Nixon U.S. Pat. No. 2,833,118 were employed, but a great deal of time was wasted in threading the cables through the gripping devices before the hoisting operation could be started, and during which "set up" time the platform and caissons were in constant danger of being seriously damaged by wind and wave action. The danger continued during the jacking operation, which was very slow, until the platform was raised high enough to clear the waves.

SUMMARY OF THE INVENTION

The present invention overcomes the difficulties found in prior barge and platform elevating or jacking devices, in that it makes it possible to reduce to a minimum the jacking time required to elevate a barge or platform to working height on a supporting structure, particularly in rough seas, when time is a very critical factor.

The preferred support structure is prefabricated in the form of a tripod with the vertical legs consisting of large diameter caissons, rendered watertight, and provided with flood control valves. Conductor pipes for subsequent use in drilling operations are preferably installed in the caissons at the shipyard, since this will save time later in starting drilling operations. The support structure is towed to the site in a horizontal position and caused to assume a vertical position by controlled flooding of the caissons to sink the structure until its footings engage the sea bottom. The drilling and production platform is also completely prefabricated in a shipyard and towed to the site. The platform is preferably fully equipped with all components necessary for drilling and oil production, and has cargo and pipe handling cranes, power plants, utilities, pumps, crew's quarters, a heliport, the present novel jacking equipment, etc. The design of the jacking equipment is such that safe, low maintenance drilling and production platforms can be installed in rough waters at substantial savings in time and money over prior conventional structures, and without requiring the use of additional auxiliary equipment, such as derrick barges, etc., which cause most of the weather delays in erecting a drilling platform. All machinery and jacking equipment is tested at the shipyard, insofar as the testing of equipment can be effected at such facility. This can also save a lot of time if any equipment is found to have a malfunction.

The platform has three caisson wells, open at one side, and spaced in the same geometric pattern as the caissons of the tripod support, with one caisson well located in the bow and two at the opposite sides of the platform adjacent the stern. The platform resembles a barge and is towed to the drilling site and floated and winched into position with one of the caissons received in each caisson well. At least the caisson well in the bow has a locking gate to prevent any substantial fore and aft movement of the platform relative to the caissons.

Three pre-assembled and set-up jacking units are provided, one for each caisson. Each jacking unit is disposed within a stabilizing and jack-positioning frame mounted on the deck of the platform. Each jacking unit includes a jacking head and two pairs of upright jacking legs that are connected by self-aligning bearings to the jacking head, one pair at each end of the jacking head. The two pairs of jacking legs straddle the associated caisson well and each leg extends through a respective one of four jacking mechanisms and into a corresponding opening in the platform hull. Each jacking mechanism is connected at its lower end to the platform deck by a gimbal joint. Each jacking head has a pilot to center it on the upper end of a caisson.

The jack-positioning and stabilizing frames have trolleys mounted therewithin on opposite sides of the frame, and pulleys and tensioned cables connected with the jacking head, and snubbing means to keep the jacking heads centered in the frame. Additional, winch-operated cables hold the jacking heads suspended above the upper end of their associated caissons until the jacking operation is to commence; whereupon, the jacking heads can be quickly lowered onto the upper end of the caissons and the operation of jacking up the platform can be started without delay. This is a valuable and unique feature of the invention because it avoids the delay due to "set up" time in starting jacking operations with prior devices. Such delays can be very costly and extremely hazardous in rough waters.

Each jacking mechanism includes two axially spaced slip holders surrounding a jacking leg and connected together by four hydraulically operated cylinders and pistons that are simultaneously operated. Each holder contains a set of wedgeshaped slips that are self-energizing in one direction, i.e., they can move freely upwardly on the jacking legs, but automatically grip the jacking legs and will not move downwardly unless deliberately de-energized. In this connection, the slips are de-energized to allow the jacking leg to move downwardly therethrough as the jacking heads are being lowered onto the upper end of the caissons.

The sets of slips are operable by the hydraulic cylinders to elevate the platform by incremental movement relative to the associated caisson. At the same time, the slips will hold the platform in any position to which it is raised by wave action and prevent it from dropping back onto the water. This is another important and valuable feature of the invention because it prevents damage to the platform and caissons, and possible injury to personnel. It also takes advantage of wave action during jacking by allowing the platform to move upwardly even during a jacking stroke, so that it quickly reaches a height where damage and danger from wave action is eliminated.

All four jacking mechanisms of each jacking unit must be simultaneously operated. On the other hand, the three jacking units can be selectively operated, or all three can be simultaneously operated. In each instance, the upper end of the caisson takes the full reaction of the platform jacking effort. The stabilizing frames retain the jacking units in proper position, while permitting universal movement thereof relative to the platform without interfering with the jacking operations.

The use of self-energizing slips in the jacking mechanisms provides a valuable "fail safe" feature. Further safety is achieved with the present invention by designing the jacking mechanisms so that, once the jacking operation has been commenced, it must be continued to completion. This result is obtained by effecting automatic and positive locking of the slips in their energized position and requiring manual release of the locking means. The positive locking of the slips in energized position, and requiring manual release thereof, serves to prevent inadvertent release of the jacking mechanisms and dropping of the platform onto the water, which can and has occurred with the use of prior jacking devices.

The invention also contemplates elevating a platform having a single caisson well on a single caisson constructed in the form of a "monopod" and consisting of a single large caisson mounted upon three or more supporting legs. In such instance, a stabilizing frame and jacking unit may be mounted on the platform to receive the caisson in straddling relation. A jacking unit need not straddle the caisson, although such arrangement equalizes the jacking load on opposite sides of the caisson. One or more jacking legs, arranged in non-straddling, cantilever fashion relative to the caisson, can be used in some instances.

The present methods and apparatuses are designed especially for use at sea in deep water of a depth of 200 to 400 feet or more, and to withstand severe wave action and high wind velocities. The present platforms may be elevated as high as 95 feet above mean water level to be certain that they will be clear of wave action during severe storms.

Accordingly, the principal object of the invention is to provide a method and apparatus for safely elevating an off-shore platform above wave level and to a working height in a minimum of time.

Another object is to provide a method and apparatus for jacking up a platform on one or more bottomed caissons, wherein the platform is prefabricated and maneuvered into position relative to the caisson or caissons, and the jacking apparatus is rendered functional without requiring any substantial "set up" time.

Another object is to provide a method and apparatus for elevating a platform on one or more caissons, which employs the novel technique of utilizing the upper end of the caisson as a load-reaction and bearing point for the platform jacking effort, and which effort is also applied directly to the platform.

Still another object is to provide a method and apparatus for elevating a platform on a caisson, according to which a downward pull is exerted on the upper end face of the caisson simultaneously with exerting a direct upward pull on the platform.

Still another object is to provide a method and apparatus for elevating a platform on a caisson, according to which a connection is established by rigid means between the upper portion of the caisson and the platform deck, and the connection is successively shortened and the platform is correspondingly successively raised and held in the position to which it has been raised upon shortening of the connection.

A further object is to provide a method of erecting a prefabricated support structure, comprising at least one upright caisson, on a sea bed and moving a prefabricated platform into position to be supported on at least the one caisson, characterized by pre-positioning at least one jacking unit on the platform so that the jacking head thereof can be quickly lowered onto the upper end of at least the one caisson; and jacking operations commenced immediately after the platform has been positioned relative to at least the one caisson.

A still further object is to provide a platform with one or more self-elevating jacking units mounted thereon, with a jacking unit having a single jacking leg prepositioned to be connected with a caisson in cantilever fashion, or with the units having one or more pairs of jacking legs pre-positioned to receive and straddle one or more platform-supporting caissons.

Still another object is to provide a platform with a system of self-energizing jacking units embodying "fail safe" features, so that, once the operation of jacking the platform on one or more caissons has been started, the platform cannot accidentally drop back onto the water.

Still another object is to provide a platform jacking system including a jacking mechanism constructed so that during a jacking operation, if the platform is raised relative to a caisson by wave action, the jacking mechanism will automatically hold the platform in its raised position on the caisson and prevent it from moving downwardly as the wave action subsides.

A still further object is to porvide a platform with one or more jacking units each including a jacking head and jackpositioning and stabilizing means therefor that serve to position the jacking head on a caisson, and which will also steady the jacking unit while compensating for movement of the platform relative to the caisson due to wind and wave action during the time that the platform is being elevated to a height clear of the water.

Still another object is to provide a jacking mechanism to be used with a jacking leg, including two holders each containing a set of one-way wedge slips enabling the holders to be moved freely only in an upward direction relative to the jacking leg.

Still another object is to provide a jacking mechanism to be used with a jacking leg, including two sets of wedge slips that are automatically locked in place when moved to their energized position, and wherein the locking means must be manually released before the slips can be moved to their de-energized position.

Other objects and advantages of the invention will be apparent from the following description taken in conjunction with the accompanying drawings.

DESCRIPTION OF THE DRAWINGS

FIG. 11 is an enlarged fragmentary elevational view of one of the jacking legs and its associated jacking mechanism, and further showing the gimbal mounting for connecting the lower end of the jacking mechanism to the platform.

FIG. 12 is an enlarged fragmentary vertical sectional view, taken on the line 12—12 of FIG. 11, through the upper set of slips of the jacking mechanism.

FIG. 13 is a fragmentary vertical sectional view, taken on the line 13—13 of FIG. 11, through the lower set of slips of the jacking mechanism.

FIG. 19 is an enlarged cross-sectional view showing the slip-actuating ring locked in its slip-energizing position by a locking pin.

FIG. 20 is a similar view showing the locking pin withdrawn and the actuating ring in its slip de-energizing position.

FIG. 21 is an enlarged horizontal sectional view, taken on the line 21—21 of FIG. 11, showing the slip-actuating ring for the upper set of slips and its operating cylinders.

FIG. 21A is a fragmentary elevational view of one of the operating cylinders shown in FIG. 21.

FIG. 22 is an enlarged horizontal sectional view, taken on the line 22—22 of FIG. 11, showing the slip-actuating ring and operating cylinders for the lower set of slips.

FIG. 27 is a diagrammatic plan view of the jacking head and single cantilever jacking leg, shown in FIGS. 25 and 26.

FIG. 28 is a diagrammatic plan view showing a further embodiment having a jacking head with two cantilever jacking legs disposed in non-straddling relation to a caisson well.

FIG. 29 is a diagrammatic plan view of another embodiment having a jacking head with a single pair of jacking legs attached thereto and straddling a caisson well.

FIG. 30 is a similar view of a still further embodiment having a jacking head with three pairs of jacking legs attached thereto.

DESCRIPTION OF THE PREFERRED EMBODIMENTS

Figure 1:
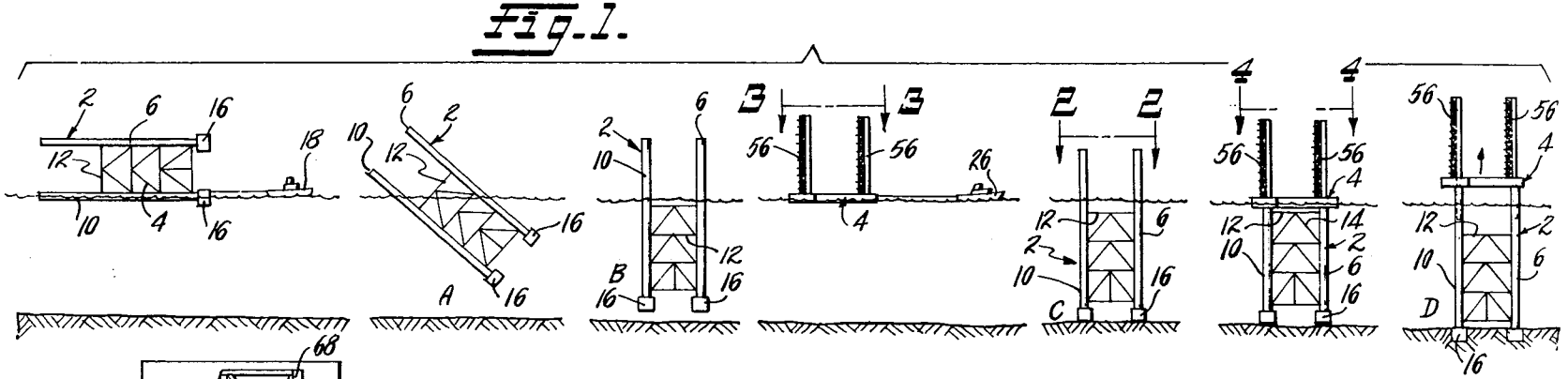
FIG. 1 is a schematic view illustrating the method of positioning a tripod type caisson supporting structure and erecting an off-shore drilling and production platform thereon in accordance with the present invention.
Figure 2:
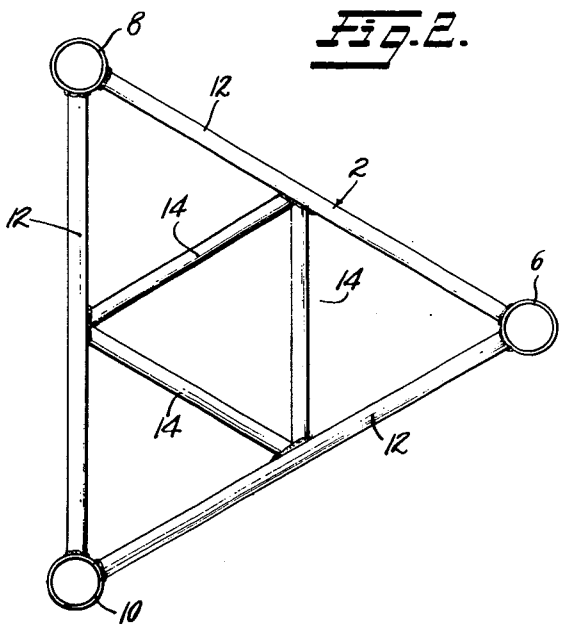
FIG. 2 is a plan view of the tripod supporting structure, as viewed on the line 2—2 of FIG. 1.

FIG. 1 of the drawings schematically illustrates the two principal components, and the successive steps involved in the method of erecting an off-shore well drilling platform in accordance with the present invention. The two components are: a prefabricated platform support structure 2; and a prefabricated drilling platform 4. The support 2 has three caissons 6, 8 and 10 rigidly interconnected by side frame members 12 and internal braces 14. The caissons 6, 8 and 10 (FIG. 2) and the frame members 12 form an equilateral triangle. Each caisson has an enlaarged footing 16 at one end to engage and be embedded in and anchored to the sea bottom in a known manner. Conductor pipes (not shown) are preferably installed in the caissons during fabrication since this will save a great deal of time later in getting started with the drilling operations. The ends of the caissons are sealed watertight so that the assembly will float horizontally and can be towed to the drilling site by a tug 18. The caissons 6, 8 and 10 have flood valves (not shown) enabling the caissons to be flooded with sea water gradually turned from a horizontal to a vertical position, as illustrated at A and B, respectively, and completely sunk at the drilling site, as shown at C, with the caissons disposed in the proper azimuth. The caissons 6, 8 and 10 are of predetermined length such that when the support 2 is sunk and anchored to the sea bottom, as shown at D, they project above the water to a height slightly greater than the working height to which the platform 4 is to be elevated. The length of the caissons 6, 8 and 10 is determined by the depth of the water at the drilling site and the height to which the platform 4 is to be elevated above the water.

The prefabricated platform 4 resembles the hull of a barge and is provided at the shipyard with living quarters and all equipment necessary for oil well drilling and production operations. All such equipment has been omitted from the drawings since it constitutes no part of the present invention.

Figure 3:
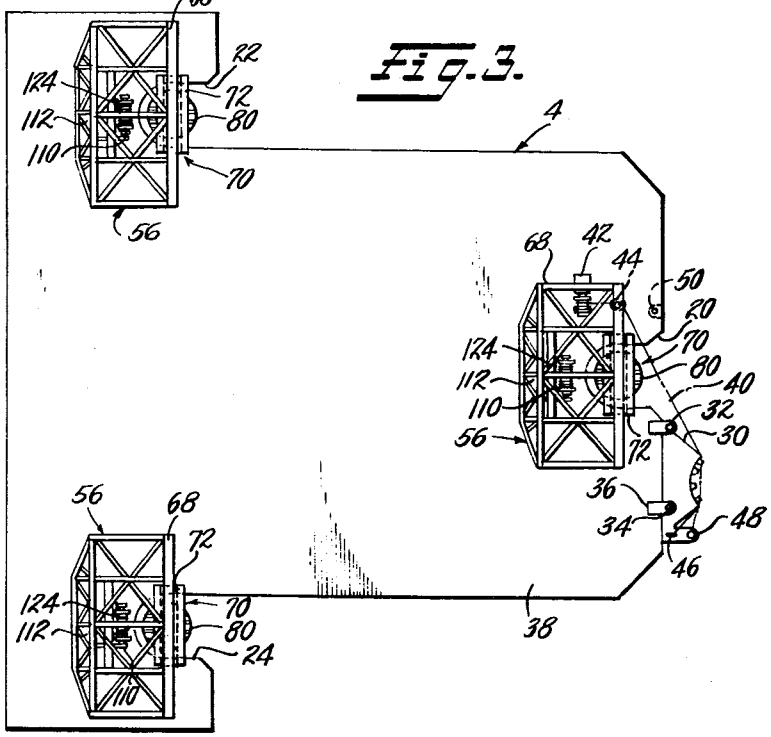
FIG. 3 is a plan view of the platform, as viewed on the line 3—3 of FIG. 1, but showing the locking gate for one of the caissons in its open position.
Figure 4:
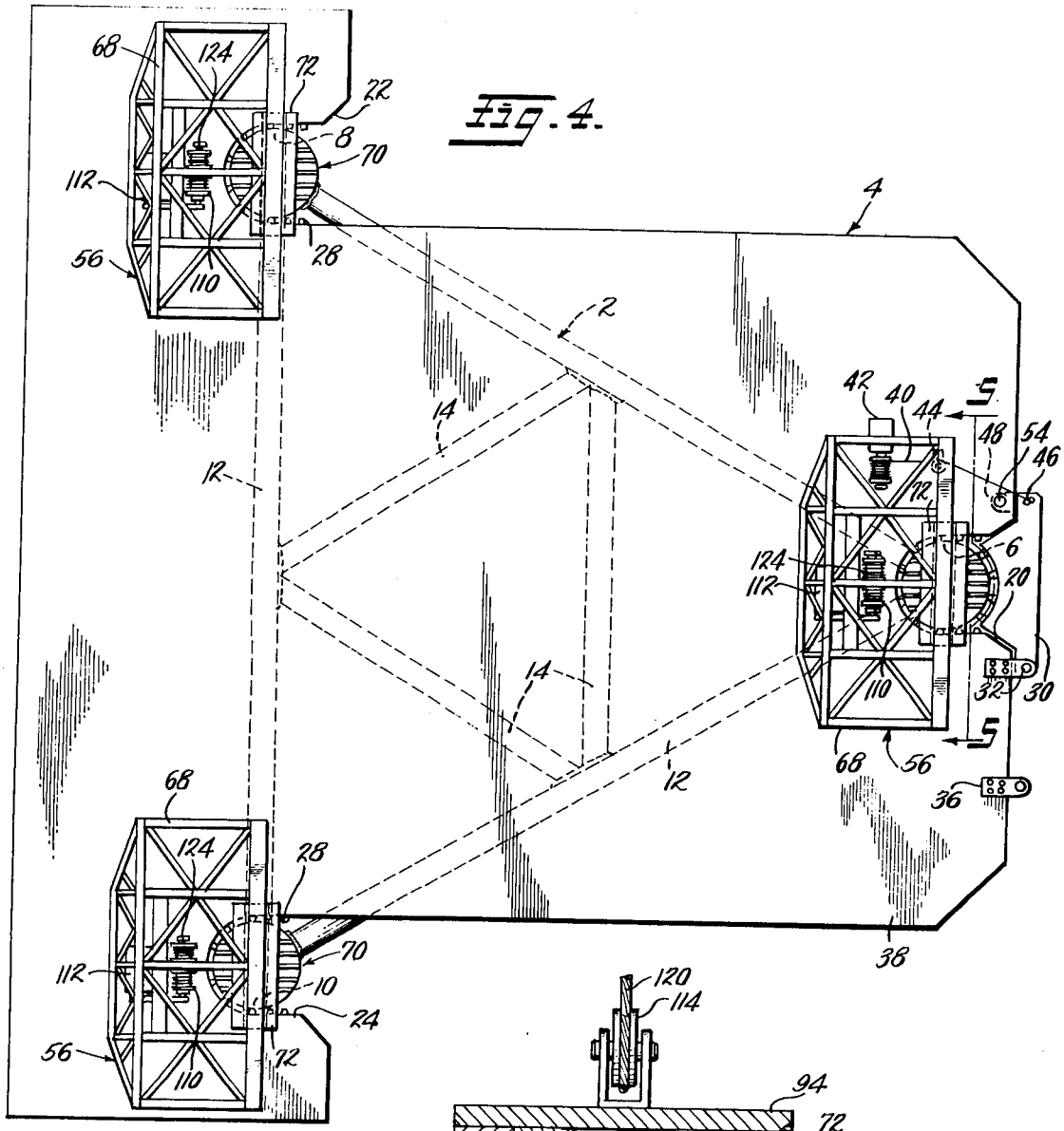
FIG. 4 is an enlarged plan view similar to FIG. 3, but showing the locking gate in its closed position.

The platform 4 preferably has the generally rectangular configuration shown in FIGS. 3 and 4. The bow has a central slot or caisson well 20, flaired and open for its full height, for receiving the caisson 6. Additional open slots or caisson wells 22 and 24 are provided on opposite sides of the platform 4 near the stern for receiving the caissons 8 and 10, respectively. The platform is buoyant and is towed to the drilling site by a tug 26, FIG. 1. After the support 2 has been bottomed, the platform 4 is floated into position above the framework 12-14 and maneuvered by cables and winches (not shown) connected with the caissons, into a position wherein the caissons are received in their respective caisson wells, as shown in FIG. 4. All of the caisson wells 20, 22 and 24 have yieldable buffer strips 28 mounted therein for engagement with the caissons to prevent damage to the platform and caissons.

Figure 10:
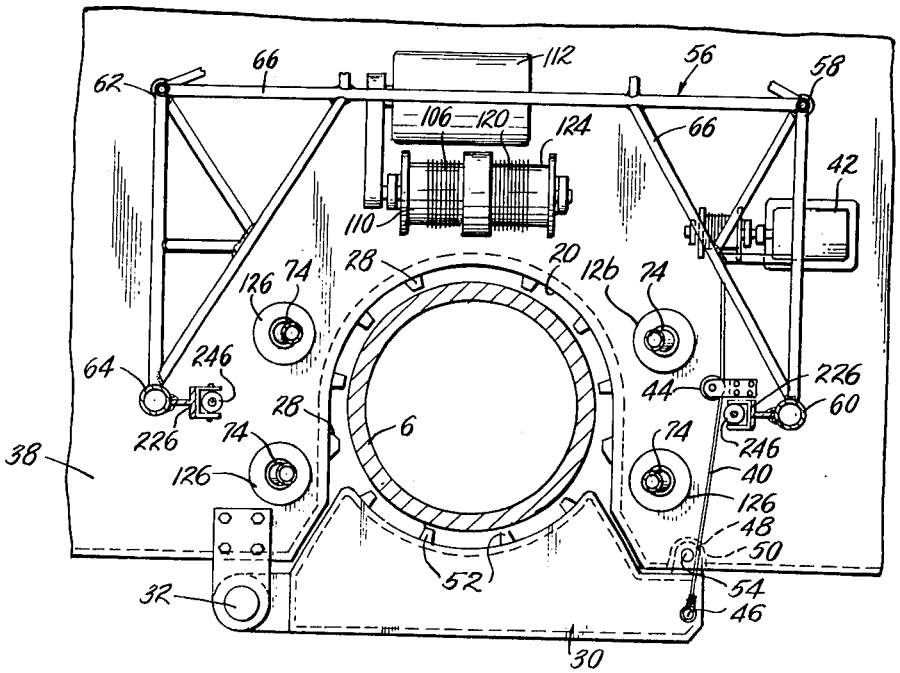
FIG. 10 is an enlarged fragmentary horizontal sectional view, taken on the line 10—10 of FIG. 5, showing the poweroperated means for closing the locking gate.

A locking gate 30, FIGS. 3, 4 and 10, is hinged at 32 adjacent one side of the caisson well 20 and, in FIG. 3, is shown held in open position by a pin 34 extending through a keeper 36 welded to the deck 38 of the platform 4, the pin extending into a suitable opening in the top of the gate 30. After the caisson 6 has been received in the caisson well 20, a cable 40, extending from a winch 42 and around a pulley 44 and across the front of the gate 30, is connected to a hook 46 on the gate 30. The winch 42 and the pulley 44 are both mounted on the platform deck 38. Upon removal of the pin 34 and operation of the winch 42, the cable 40 will pull the gate 30 from its open position into its locking position, illustrated in FIGS. 4 and 10. The gate 30 has a projecting tongue 48 and the platform has a recess 50 to receive the tongue as the gate 30 is closed. When the gate is in its fully closed position, a retaining pin 54 is inserted through an opening in the deck 38 and into an aligned opening in the tongue 48, thus positively locking the gate 30 in its closed position. It will be noted that the locking gate 30 has an arcuate face to which buffing elements 52 are attached and engageable with the caisson 6 to prevent damage to the gate and caisson as a result of any movement of the platform 4 relative to the caisson. It will be understood that locking gates may also be provided for the caisson openings 22 and 24, if desired, and that in all instances a clearance is provided between the caissons and buffing elements.

A superstructure in the form of a jack-positioning and stabilizing frame 56 is mounted upon the deck 38 behind each of the caisson wells 20, 22 and 24, as shown in FIGS. 3, 4, 5, 6 and 10. The frame 56 comprises four uprights with two uprights 58 and 60 disposed at one side of each caisson well, and uprights 62 and 64 disposed at the other side of the wells, with the uprights 60 and 64 disposed in a vertical plane substantially coinciding with the axis of the associated caisson. The uprights 58, 60, 62 and 64 are connected together by braces and struts generally identified by the numeral 66. The upper end of each of the uprights 58, 60, 62 and 64 is connected to a fabricated top structure 68. It will be understood that the illustrated components of the frames 56 are welded together, and that the tops 68 of the frames 56 are at a height well above that of the upper end of the caissons 6, 8 and 10.

Each of the frames 56 serves as a positioning and stabilizing support for a jacking unit generally identified by the numeral 70. Each jacking unit includes a jacking head 72 and four jacking legs 74, pivotally connected at 76 to the jacking head 72 and arranged so that the legs will straddle a caisson, with one pair of legs disposed on either side of the caisson and extended through openings 78 in the platform hull adjacent to the frame uprights 60 and 64. The pivotal connections 76 are self-aligning bearings that permit universal movement between the upper end of each jacking leg 74 and the jacking head 72.

Figure 9:
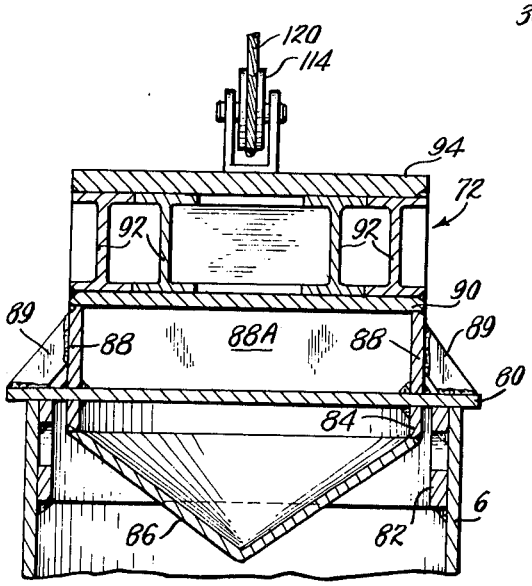
FIG. 9 is a vertical sectional view through the jacking head and upper end of the caisson, taken on the line 9—9 of FIG. 7.
Figure 7:
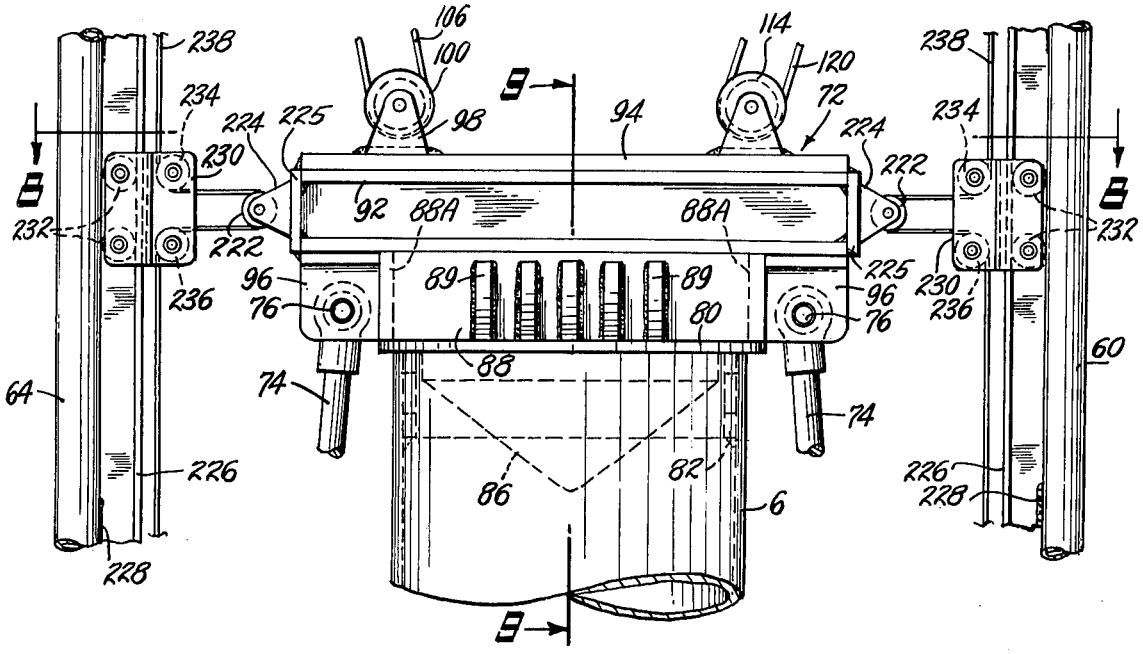
FIG. 7 is an enlarged fragmentary elevational view of the jacking head and trolleys, cables and pulleys of the jackstabilizing means.
Figure 8:
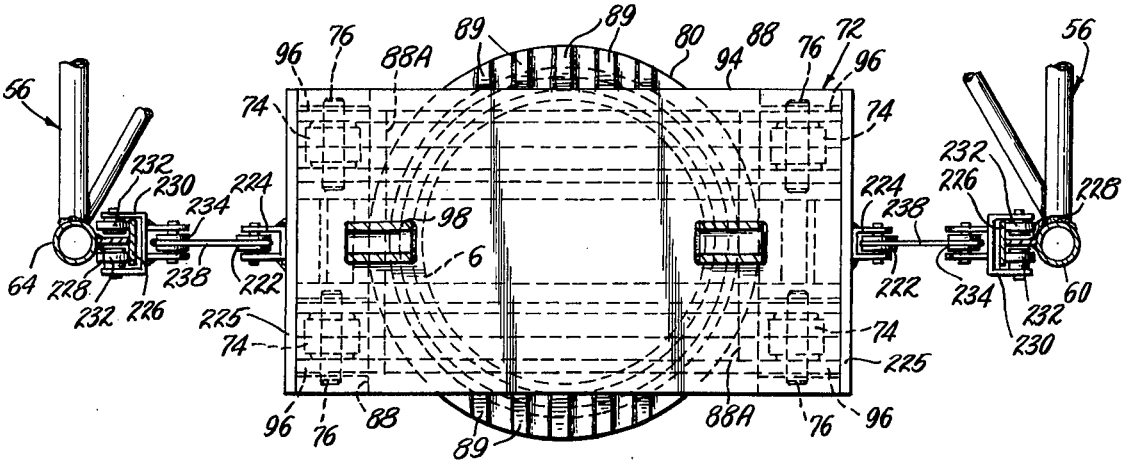
FIG. 8 is a sectional plan view, taken on the line 8—8 of FIG. 7.
Figure 14:
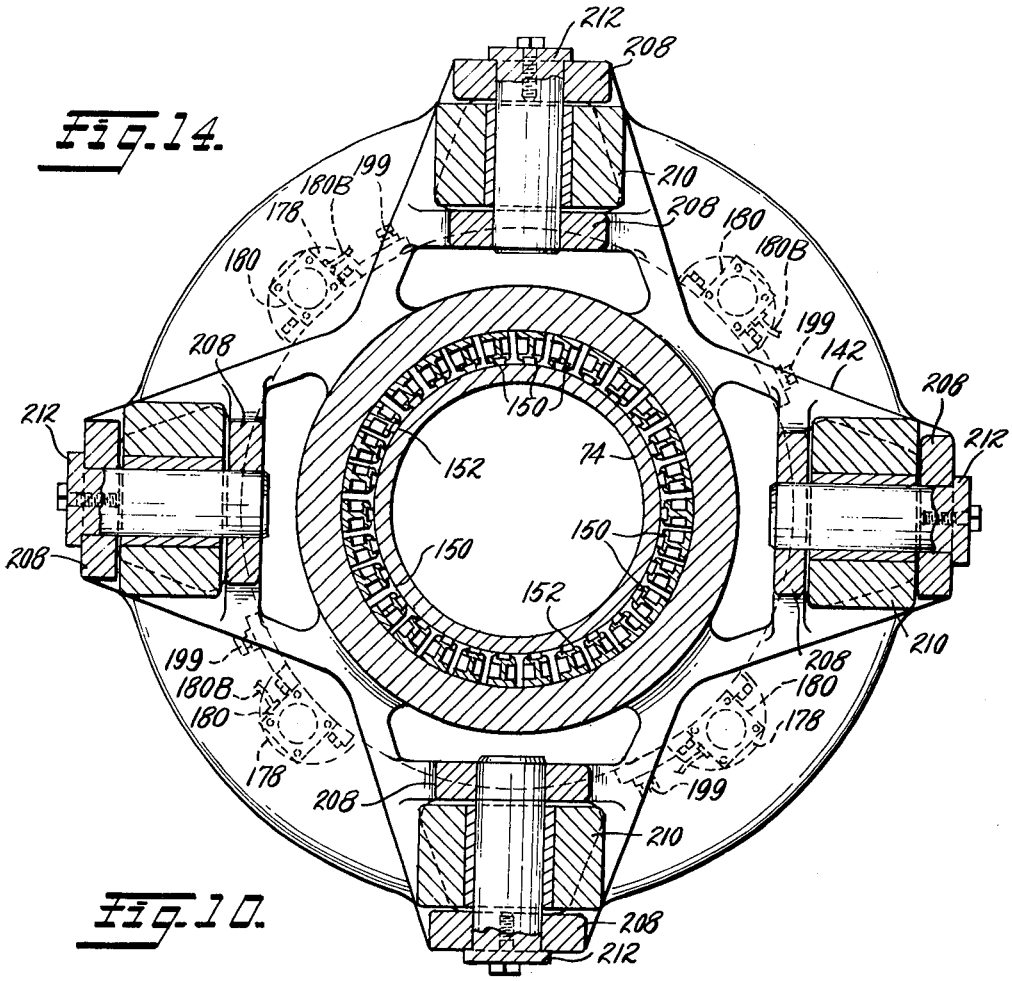
FIG. 14 is a horizontal section view through the lower set of slips and the upper section of the gimbal mounting, taken on the line 14—14 of FIG. 11.

Referring to FIGS. 7, 8 and 9, the jacking head 72 may be constructed in any suitable manner, but, by way of example, is shown as a rectangular, box-like structure including a main, or head plate 80 which, when in use, rests upon the upper end face of a caisson 6, for example. Each caisson has a reinforcing ring 82 welded to the interior thereof so that the upper edge of the ring 82 lies in a plane flush with the upper end of the caisson. The ring 82 reinforces and increases the load bearing area at the upper end of the caisson with a consequent reduction in unit pressure. A ring 84, smaller in diameter than the ring 82, is welded to the underside of the head plate 80, and has a conical pilot member 86 welded thereto for guiding the jacking head 72 into position when lowered upon the caisson and for retaining the jacking head 72 in place and in axial alignment with the caisson 6. Side plates 88 and end plates 88A are welded to the upper side of the head plate 80 to form the rectangular box. Gussets 89 welded to the plates 88 and to the plate 80 reinforce the plate 80 in the areas thereof overlying the caisson. A rectangular plate 90 is welded to the upper edge of the plates 88 and 88A, and a plurality of I-beams 92, arranged side by side in spaced pairs, is welded at their lower flanges to the upper side of the plate 90. A top plate 94 is welded to the upper flanges of the I-beams 92. The opposite ends of the plate 90 extend beyond the end plates 88A and two brackets 96 are welded to each of the extended portions of the plate 90 and mount the bearings 76 connected with the upper end of the jacking legs 74. The plate and I-beam arrangement shown provides a very rigid and strong jacking head 72, capable of supporting a proportionate share of the weight (1/3) of the platform 4 and the drilling equipment (not shown) mounted thereon.

A bracket 98, FIGS. 5 to 9, is welded to the top plate 94 and has a pulley 100 mounted thereon. Additional pulleys 102 and 104 are mounted on brackets 105 secured to the lower side of the top beam 68, and a cable 106 has one end anchored at 108 to said top beam, and extends over the pulleys 100, 102 and 104, and then downwardly to a drum 110 of a dual drum winch 112 mounted on the deck 38. A pulley 114 is similarly mounted on the top plate 94 and two additional pulleys 116 and 118 are mounted in brackets 107 on the underside of the top beam 68. A second cable 120, anchored to the top beam at 122, extends around the pulleys 114, 116 and 118, and then downwardly to another drum 124 of the winch 112. It will be understood from the foregoing that the winch 112 can be operated to raise or lower the jacking head 72 and its attached jacking legs 74 as a unitary structure.

A jacking mechanism, generally identified by the numeral 126, surrounds each of the jacking legs 74 so that each jacking unit includes four separate jacking mechanisms 126 that are operated in unison. Each of the jacking mechanisms 126 has a gimbal joint connecting the lower end thereof with the platform deck 38 for universal movement relative thereto. The gimbal joint comprises a ring 128, FIGS. 5 and 11, that is pivotally mounted at diametrically opposite points on pins 130 that are received in aligned openings in spaced plates 132 and 134, extending through the platform deck 38. The plates 132 and 134 are welded below the deck 38 to a bulkhead 136, the plate 134 being positioned adjacent to a cylindrical section 138 providing one of the openings 78 for a jacking leg 74. The upper end of each plate 134 is beveled, as shown at 140, to provide for at least ten degrees of angular movement between the lower gimbal ring 128 and a housing 142, constituting the other element of the gimbal joint. The housing 142 has diametrical lugs 144 extending downwardly therefrom that are connected by pins 146 with the gimbal ring 128. The pins 146 are disposed on a diametrical axis at right angles to the axis of the pins 130.

Figure 15:
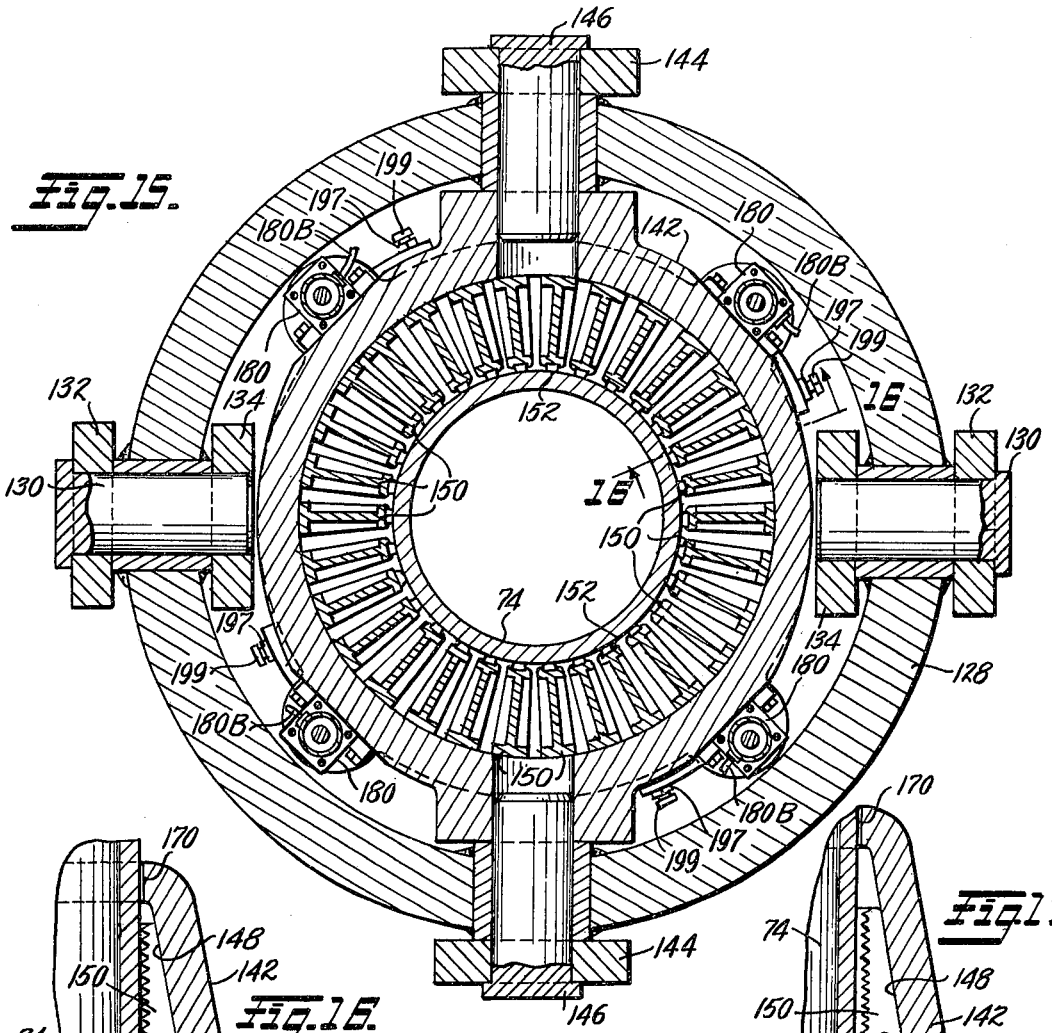
FIG. 15 is a similar view through both sections of the gimbal mounting, taken on the line 15—15 of FIG. 11.
Figure 18:
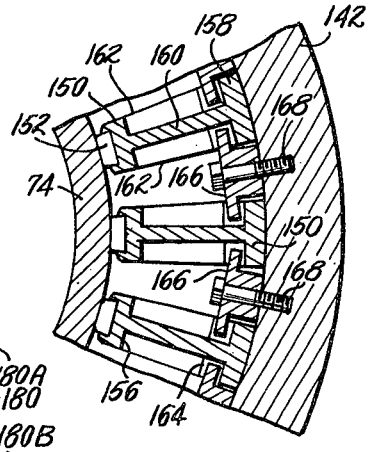
FIG. 18 is an enlarged fragmentary horizontal sectional view, taken on the line 18—18 of FIG. 16, showing the retaining and guide means for the slips.

The housing 142, FIG. 13, has a frusto-conical internal recess 148 for receiving a series of wedge-shaped slips 150 having a toothed inner surface 152 for gripping a jacking leg 74, and an upwardly and inwardly inclined smooth outer surface 154 engaging the conical surface of the recess 148. The slips 150 are arranged side by side and, as is best shown in FIG. 15, are slightly spaced apart so that a maximum number can be carried by the housing 142, which serves as a slip holder. Each of the slips 150 has an inner wall 156 and an outer wall 158, a central web 160, and ribs 162 on opposite sides of the web 160 interconnecting the front and rear walls. A portion of three of the ribs 162 of each slip is cut away, as indicated at 164, FIGS. 16 and 18, to receive the head of a T-shaped retracting camming member 166. One of the camming members 166 is disposed between the adjacent sides of each pair of slips 150 and is secured to the holder 142 by bolts 168. Thus, means is provided to permit limited axial, as well as radial, movement of the slips 150 relative to the slip holder 142.

Figure 16:
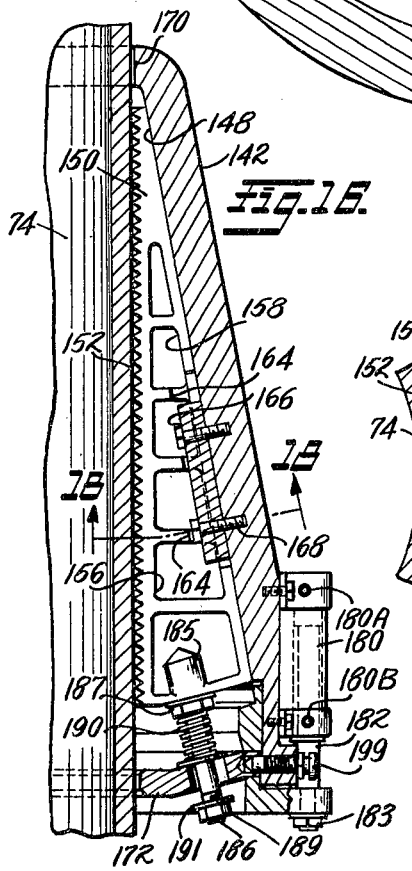
FIG. 16 is a fragmentary vertical sectional view, taken on the line 16—16 of FIG. 15, through the lower set of slips and showing one of the slips engaging the support caisson and the locking means for retaining the slips in energized position.
Figure 17:
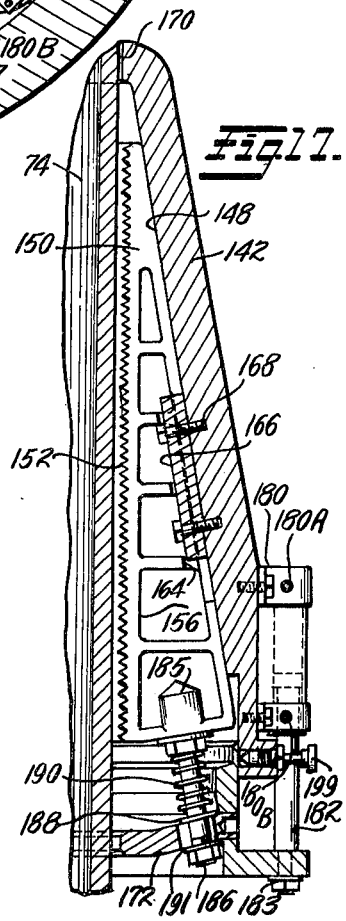
FIG. 17 is a fragmentary vertical sectional view similar to FIG. 16, but showing the locking means released and the ring connected with the slips retracted to move the slips to deenergized position.

It will be noted from FIGS. 16 and 17 that the upper end of the slip holder 142 has an inwardly directed flange 170, spaced from the jacking leg 74 that serves as a guide for the upper portion thereof. A slip-actuating ring 172 (see also FIGS. 19 and 20) serves as a guide for the lower portion of the holder 142. With furthr reference to FIGS. 13 and 19, the lower end of the holder 142 has a counterbore 174 to receive a flange 176 extending upwardly from the ring 172. Four lugs 178, FIG. 22, extend radially from the ring 172 at equally spaced, circumferential points. Four air cylinders 180, each having an upper air line connection 180A and a lower air line connection 180B are mounted on the slip holder 142 in alignment with the four lugs 178. A piston rod 182 extends from each cylinder 180 and is connected by a nut 183 to one of the lugs 178. The ring 172 has an elongated opening 184, FIGS. 19 and 20, in alignment with a stud bolt 186 extending from each of the slips 150. Each stud bolt 186 is mounted in a boss 185 and locked by a jam nut 187. A washer 188 is mounted on each stud bolt 186 above the ring 172. A compression spring 190 surrounds each of the stud bolts 186 between te jam nut 187 and the washer 188 and normally urges the slip 150 upwardly into wedging engagement with the jacking leg 74. A castellated nut 189 carrying a washer 191 is threaded on each stud bolt 186 below the ring 172 and locked in place by a cotter pin 193.

The holder 142, FIGS. 15, 19 and 20, has four threaded openings 195 formed therein spaced 90° apart. A fitting 197 is mounted in each opening and slidably receives a locking pin 199. The pin 199 has a portion that extends outwardly beyond the fitting 197 and has a retracting head 201 mounted thereon. The slipactuating ring 172 has four radial holes 203 aligned with the four threaded openings 195 in the slip holder 142. A compression spring 205 in each of the openings 195 urges the locking pins 199 inwardly.

It will be understood that when the air cylinders 180 are operated to raise the actuating ring 172, the spring 190 will be compressed and urge the slips 150 upwardly and inwardly to their energized position engaging the jacking leg 74. The upper edge 150A of the flange 176 will engage the shoulder of the counterbore 174 and position the holes 203 in axial alignment with the locking pins 199, which will be forced by the spring 205 into the holes 203 to positively lock the actuating ring 172 in slip-energizing position. The cylinders 180 cannot now be inadvertently operated to de-energize the slips 150, and this is an important safety feature of the invention that prevents the platform from being dropped.

In order to release or de-energize the slips 150, each of the pins 199 must be manually retracted by a suitable tool (not shown) and held in its retracted position clear of the holes 203. When all four pins 199 have been retracted, the springs 190 will tend to move the ring 172 downwardly toward the position shown in FIG. 20. The foregoing procedure must be repeated with the jacking mechanism 126 associated with each of the four jacking legs 74 before the four cylinders 180 are operated to move the actuating ring 172 downwardly into engagement with the washers 191 and apply positive force to the stud bolts 186 to move the slips 150 downwardly. The camming members 166 will automatically cause the slips 150 to move radially outwardly to de-energized position as they are moved downwardly. The downward movement of the ring 172 is limited by the stroke of the piston rods 182.

Each jacking mechanism 126 includes an upper slip holder 194, FIGS. 11 and 12, 21A that has a frusto-conical recess 196 containing a series of wedge-type slips 198, similar to the slips 150, and similarly mounted therein. A flange 200 at the upper end of the holder 194 has a suitable clearance with the jacking leg 74 and serves as a guide. An actuating ring 202, similar to the ring 172, is mounted at the lower end of the holder 194 and is connected with the slips 198 in the same manner that the slips 150 are connected with the ring 172. The ring 202 is also connected with the pistons 204 of four air-operated cylinders 206, FIG. 21, mounted on the exterior of the slip holder 194 and can be similarly locked in slip-energizing position by locking pins 199A. The cylinders 206 have an upper air line connection 206A, FIG. 21A, and a lower air line connection 206B and are operable in the same manner as the cylinders 180 to operate the ring 202 to engage and release the slips 198.

Referring to FIGS. 11 and 13, the lower slip holder 142 has four sets of upwardly extending ears 208, spaced to receive the lower end of a hydraulic cylinder 210. Each cylinder 210 is pivotally connected with a pair of ears 208 by a pin 212, wherefore, it will be understood that four cylinders 210 are pivotally connected with the lower slip holder 142. Each of the cylinders 210 contains a piston 211 and has a piston rod 214 extending upwardly therefrom into a pocket 216 formed in the upper slip holder 194, FIG. 12. Each of the pockets 216 has aligned openings 218 to receive a pivot pin 220. Thus, the lower slip holder 142 and the upper slip holder 194 of each jacking mechanism 126 are pivotally connected together by four cylinder and piston rod assemblies 210–214. Fluid pressure is communicated to the opposite ends of the cylinders through upper connections 215 and lower connections 217. The upper end of all 16 cylinders 210 of each jacking unit is connected in parallel by an equalizing line 215A through the connections 215; and the lower end of all of said cylinders is connected with an equalizing line 217A through the connections 217. This arrangement prevents unequal pressure building up in the cylinders 210 during a jacking operation as the result of movement of the platform relative to a caisson by wave action. Jacking up of the platform is effected in a manner described hereinafter. Each jacking unit 70 has its own Diesel driven high pressure hydraulic pump, complete with a control panel, pressure reservoir, filters, etc. (not shown). All three pumps are interconnected to provide mutual back-up in the event of the failure of any one pump.

Figure 5:
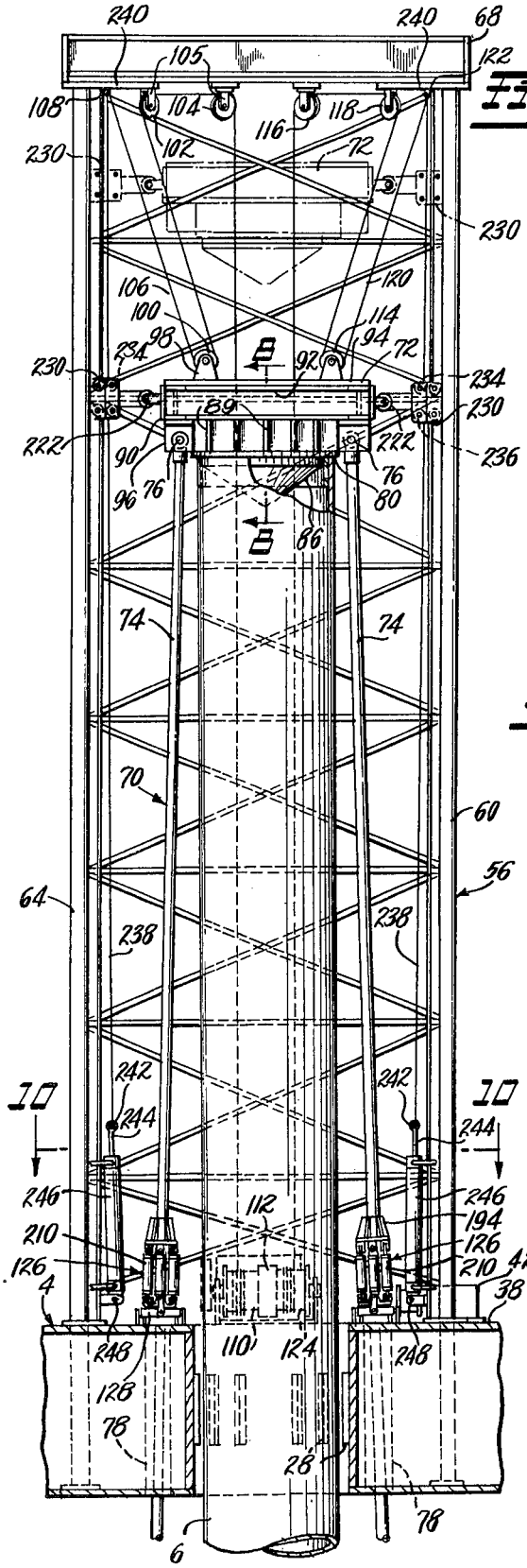
FIG. 5 is an enlarged fragmentary elevational view, partly in cross-section, taken on the line 5—5 of FIG. 4, particularly illustrating one of the jacking units and its positioning and stabilizing frame, the jacking head being shown in dot-and-dash lines elevated above a caisson, and in full lines in lowered position engaging the upper end of the caisson.
Figure 6:
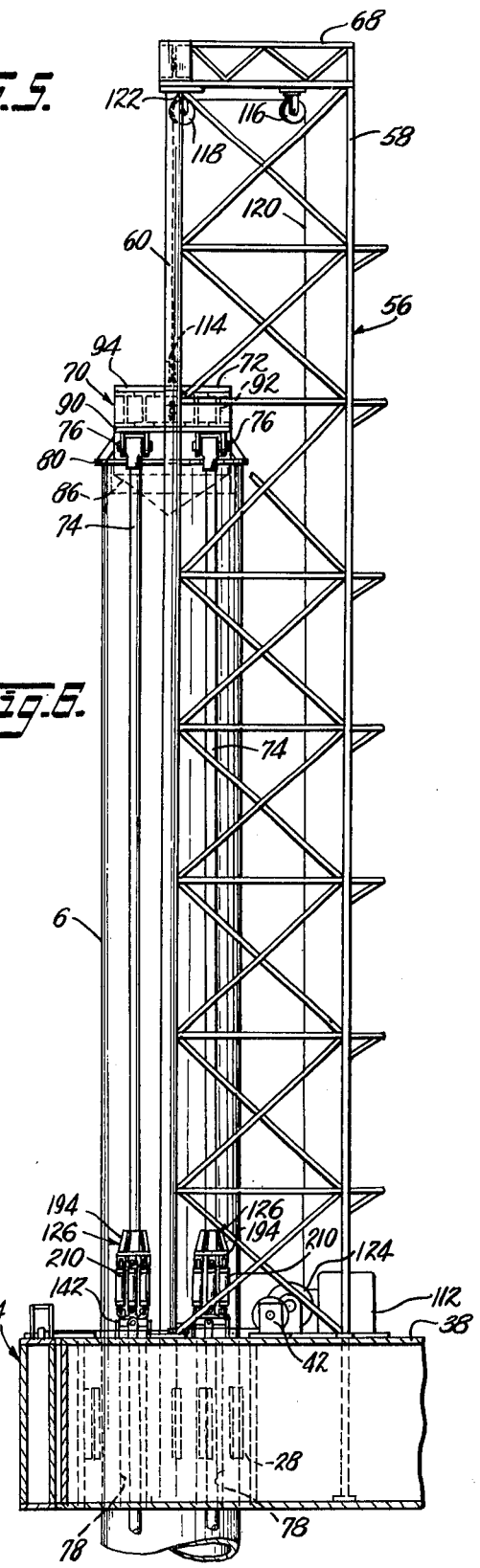
FIG. 6 is a fragmentary right-side elevational view, partly in cross-section, of the structure shown in FIG. 5.

Referring to FIGS. 5 and 6, the winches 112 may be operated to hold the jacking heads 72 aloft while the platform 4 is being towed to the drilling site. The jacking legs 74 are long enough to extend through the jacking mechanisms 126 even when the jacking heads are raised to their maximum height. Alternatively, and preferably, the jacking heads 72 are lowered toward the platform deck 38 until the jacking heads engage the upper slip holders 194 of the jacking mechanisms 126. This will eliminate swaying of the jacking heads 72 and jacking legs 74 while the platform is in transit. After the caisson support 2 has been set up on the sea bottom, and prior to moving the platform 4 into position to receive the caissons 6, 8 and 10 in the caisson wells 20, 22 and 24, respectively, the jacking heads 72 will be raised by the cables 106 and 120 through the operation of the winches 112 to a height above the upper end of the caissons, as indicated in dot-and-dash lines, so that as the platform 4 is maneuvered into position, the caissons will be disposed in axial alignment with the jacking units 70, with the jacking legs 74 set up and already straddling the caissons.

In order to stabilize the jacking heads 72 and the jacking legs 74 relative to their associated frames 56, snubbing means is provided on both sides of each of jacking units 70. Such snubbing means comprises a pulley 222, FIGS. 5 and 6, carried by a bracket 224 mounted on a plate 225, and welded to the I-beams 92 at each end of the jacking head, at about the midpoint of the plate 225. A track member 226 that is T-shaped in cross-section has the end of the stem of the T welded at 228 to each of the uprights 60 and 64, as is best shown in FIG. 8. A trolley 230 carries rollers 232 that engage the inner side of the flange of the tracks 226. The trolley 230 also carries an upper pulley 234 and a lower pulley 236. A snubbing cable 238 has one end anchored at 240 to the top beam 68 of the frame 56 and extends downwardly around the trolley pulley 234, around the pulley 222 mounted on the jacking head 72, back around the other trolley pulley 236, and then downwardly where its other end is connected at 242 to the piston rod 244 of an air pressure operated snubbing cylinder 246. The cylinder 246 is pivotally connected at 248 to the T-shaped member 226. The snubbing cylinder 246 is of substantial length, so that the rod 244 can be operated to pay out, or take up, any necessary slack in the snubbing cable 238 and still maintain the cable under adequate tension.

It will thus be seen that the jacking heads 72 are stabilized between the frame uprights 60 and 64, while at the same time they are permitted to move with respect to the frames 56 to accommodate relative movement between the platform 4 and the caissons 6, 8 and 10 due to wind and wave action. It will also be clear that the trolleys 230 will automatically move up or down on the tracks 226 relative to the stabilizing frames 56, depending upon the position of the jacking heads 72.

Assuming that the slips 150 and 198 of the jacking mechanisms have been released, the jacking legs 74 lowered therethrough and the jacking heads 72 engaged with the upper end of the caissons 6, 8 and 10, the pneumatic cylinders 180 and 206 are operated to cause the rings 172 and 202, respectively, to move upwardly and engage the slips 150 and 198 with their associated jacking legs 74. When this has been done, the locking pins 199 and 199A will automatically lock the rings 172 and 202 in slip-energizing position.

Assuming further that the pistons 211 in the hydraulic cylinders 210 are retracted, fluid is admitted through the connections 217 into the lower ends of the cylinders causing the piston rods 214 to move the upper slip holders 194 upwardly along the jacking legs 74. The slips 150 in the lower slip holder 142 are urged downwardly and automatically grip the jacking legs 74 at this time and prevent any downward movement of the slip holder 142 on the jacking legs 74. On the other hand, the slips 198 slide freely upwardly along the jacking legs 74. Free downward movement of the slips 198 in the holders 192 is permitted by a recess 198A in a flange 176A (FIG. 12). Upon completion of the piston stroke, operating fluid is admitted into the upper end of the cylinders 210 through the connections 215 and is simultaneously exhausted from the lower end of the cylinders through the connections 217. Such reverse flow can be readily effected by reversing the direction of flow from the pump units in a manner well understood in the art.

The self-energizing action of the slips 198 in the upper slip holder 194 will cause the slips 198 to tightly grip the jacking legs 74, with the result that the pistons 211 will remain stationary and the cylinders 210 will be moved upwardly, raising the lower slip holders 142 and the platform 4 connected thereto a corresponding distance. The slips 150 slide freely upwardly along the jacking legs 74 during such movement and can move downwardly relative to the holders 142, the flange 176 having a recess 150B to permit such movement. This will complete the cycle of one increment of jacking movement of the platform.

Upon repeating the cycle, the slips 150 will automatically grip the jacking legs 74 and hold the platform 4 in its raised position, while the piston rods 214 are again actuated to move the upper slip holders 194 upwardly along the jacking legs 74 to be followed by another hoisting stroke. Should wave action raise the platform 4 during a jacking stroke, the upper slips 198 will move upwardly along the jacking legs 74 to accommodate the gratuitous "boost" and hold the platform 4 in such raised position and then continue to raise it until the jacking stroke has been completed. The cycle is repeated until the platform is raised to the desired working height above the water. It is impossible for the platform to move downwardly because of the self-energizing action of the slips. The heavier the load, the tighter will be their grip.

Any leveling of the platform 4 that may be required can be effected by operating one or more of the jacking units 70 individually. The platform is then fixed to the caissons 6, 8 and 10 by welding plates (not shown) to both the caissons and platform in the caisson wells. The stabilizing frames 56 and the jacking units 70 can then be dismantled to get them out of the way.

Figure 23:
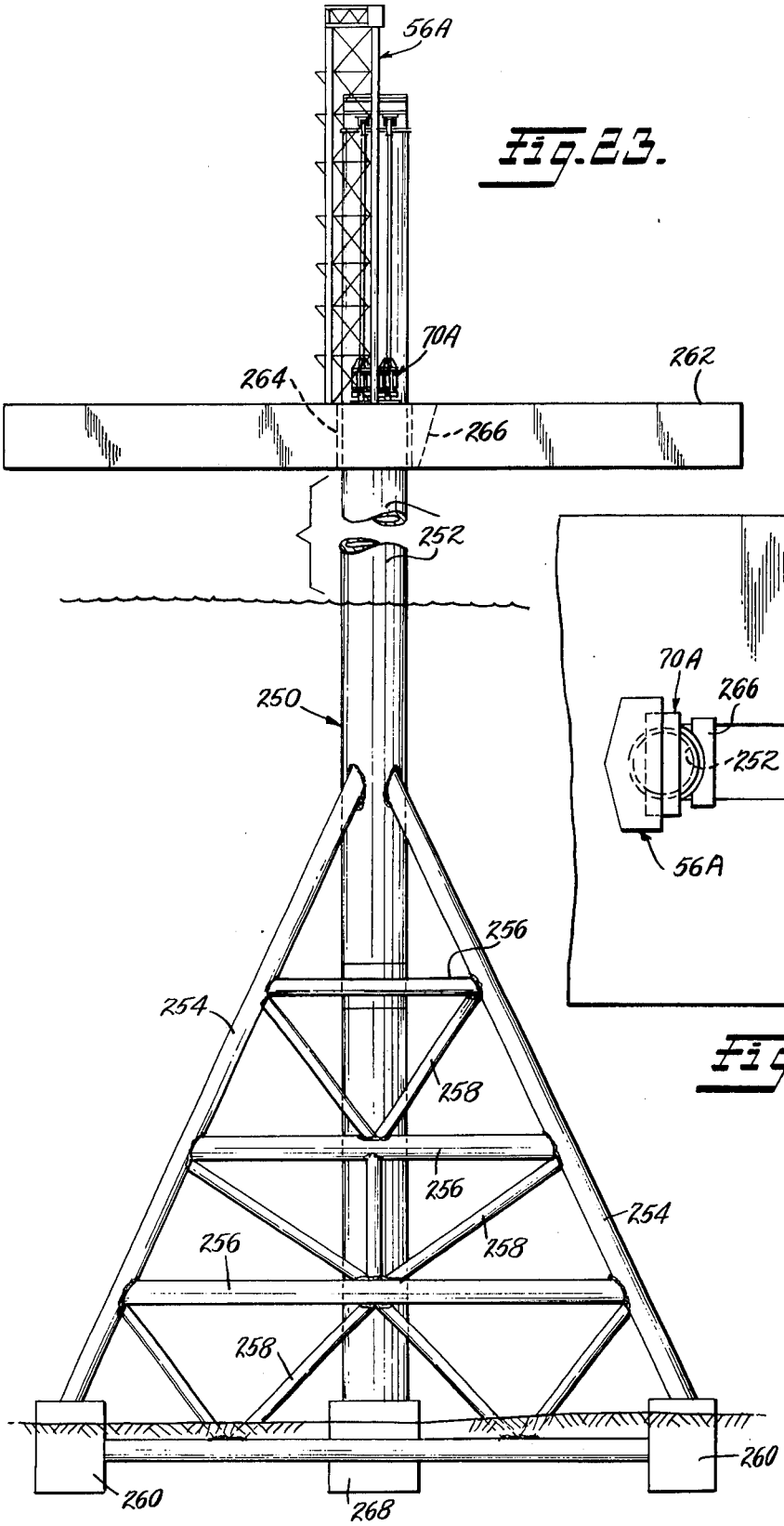
FIG. 23 is a side elevational view of another embodiment utilizing a monopod support and a platform having a single caisson well.
Figure 24:
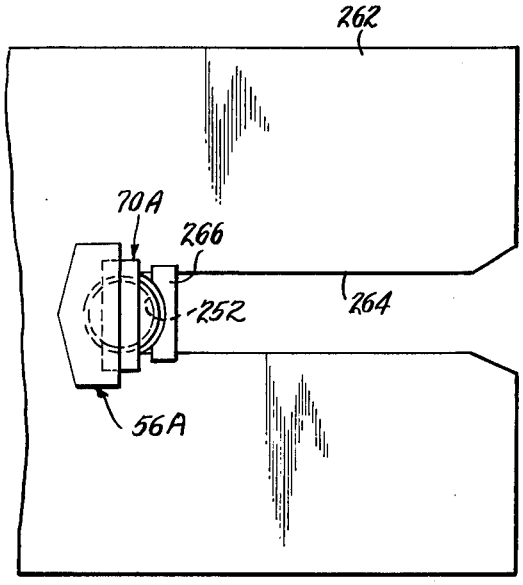
FIG. 24 is a plan view of the platform and caisson shown in FIG. 23.

The invention further contemplates elevating a platform on a single vertical caisson of large diameter supported on the sea bed by a plurality of angularly disposed legs. Such structure has been referred to hereinbefore as a "monopod" and is illustrated in FIGS. 23 and 24. The monopod 250 comprises a main caisson 252 having its lower end welded to four angularly disposed legs 254 with connecting members 256 and braces 258 disposed between the legs, and an enlarged footing 260 secured to the lower end of each leg. The monopod structure is prefabricated, rendered watertight, towed to the drilling site, and sunk to the bottom in the same general manner as the tripod caisson structure 2 described hereinbefore. After the monopod has been sunk to sea bottom, a platform 262 having a single caisson slot or well 264 extending from the bow to a point at the center of the platform, is maneuvered into position. A locking gate 266 is lowered into place by a crane (not shown) on the platform 262 to hold the platform in place. A jacking unit 70A, similar to the jacking unit 70 previously described, is pre-mounted upon the platform 262 in straddling relation to the caisson well 264. A stabilizating structure 56A, similar to the frame 56, previously described, is also pre-mounted on the platform deck around the jacking unit 70A in the same manner illustrated in FIGS. 5 and 6. The jacking unit 70A is operable in the same manner as the jacking unit 70, previously described, and is capable of incrementally raising the platform 262 to the desired height on the caisson 252. The platform 262 is fully equipped and includes the jacking unit 70A straddling the caisson well 264 and the stabilizing frame 56A for the jacking unit.

The caisson 252 preferably has a footing 268 to engage the sea bottom to provide direct support for the platform 262. The caisson well 264 is covered, after the caisson 252 has been locked in place, to provide more deck space.

It will be understood that the present invention is not limited to the use of jacking units comprising four jacking legs, nor to the use of two pairs of jacking legs straddling a caisson well. On the contrary, a single pair, or any number of pairs, of jacking legs can be employed in straddling, or non-straddling, relation to a caisson well. Furthermore, a jacking unit can be employed which comprises a single jacking leg having associated therewith a slip type jacking mechanism, such as described above.

Figures 25, 26:
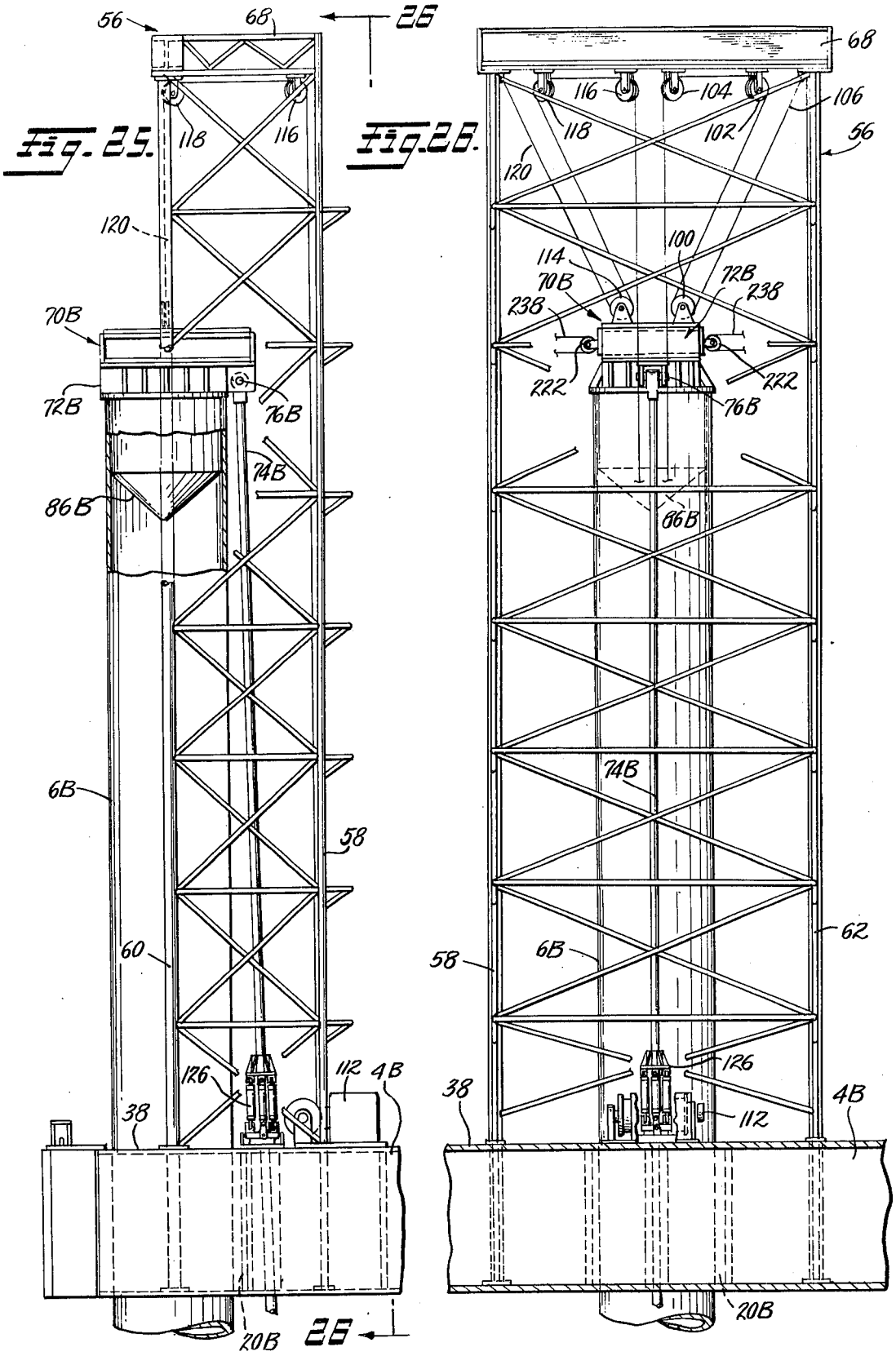
FIG. 25 is a fragmentary side elevational view of still another embodiment with portions broken away, in which a single jacking leg is arranged in cantilever fashion rearwardly of a caisson.
FIG. 26 is a right side elevational view of the structure shown in FIG. 25 with portions of the frame broken away, as viewed on the line 26—26 of FIG. 25.

Referring to FIGS. 25, 26 and 27, an embodiment is illustrated wherein a single jacking leg 74B is attached to a jacking head 72B of a jacking unit 70B by a self-aligning bearing 76B with the jacking leg 74B extending substantially vertically, and disposed close to a caisson 6B, so that a minimum of bending moment results from the cantilever action of the jacking leg 74B on the caisson 6B. In this embodiment, the jacking head 72B has a pilot portion 86B that extends into the caisson 6B for a substantial distance, so as to hold the jacking head 72B in position on the caisson and withstand the cantilever force applied by the jacking leg 74B. It will be understood that the wall of the caisson 6B is made sufficiently thick to withstand any bending stresses imposed thereon, without buckling. As is shown, the jacking leg 74B and its gimbal-mounted jacking mechanism 126 are disposed rearwardly of a caisson well 20B. The jacking unit 70B operates on the same principles as the jacking unit 70, except that a downward force is applied to the upper end of the caisson 6B, to raise the platform 4B and at only one side of the caisson, through the single jacking leg 74B. In the interest of brevity, other parts shown in FIGS. 25, 26 and 27 and previously described herein, are identified by the same reference numerals.

FIG. 28 is a diagrammatic plan view similar to FIG. 27, but illustrates two jacking legs 74C connected with a jacking head 72C in cantilever fashion. Each of the jacking legs 74C extends through a gimbal-mounted jacking mechanism 126. As is shown, the jacking legs are disposed rearwardly of the caisson well 20C and, therefore, do not straddle the caisson well.

FIG. 29 is a diagrammatic plan view of a jacking head 72D illustrating a pair of jacking legs 74D and gimbal mounted jacking mechanisms 126 arranged diametrically with respect to a caisson 6D and straddling a caisson well 20D.

FIG. 30 is a view similar to FIG. 29, but shows three pairs of jacking legs 74E connected with the opposite ends of a jacking head 72E and straddling a caisson well 20E. EAch jacking leg 74E extends through a gimbal-mounted jacking mechanism 126.

Thus, it will be seen that in the case of a platform that can be raised relative to a caisson by a single jacking leg, only one such jacking leg need be provided and, as shown in FIGS. 25, 26 and 27, it may be disposed to the rear of the caisson well, although it could be disposed on either side, as desired. FIG. 28 shows a pair of jacking legs in non-straddling relation to a caisson well. FIGS. 29 and 30 illustrate assemblies wherein either one pair of jacking legs may be employed straddling the caisson well, or three pairs may be used, depending upon the weight and character of the platform to be elevated on the caisson or caissons. Thus, it will be clear that any number of jacking legs may be connected with a jacking head, in any arrangement desired, depending upon the jacking requirements of a particular platform.

It will be understood that various changes in design and arrangement of the components of the present jacking apparatus may be made, including changes in the slip type jacking mechanism and locking means, and in the jacking head itself; and that the method of stabilizing and manipulating the jacking heads and jacking up the platforms on the supports may be varied, all without departing from the principles of the invention or the scope of the annexed claims.

I claim:

1. The method of quickly elevating a drilling and production platform on a support including at least one bottomed, upright caisson, comprising the steps of: floating the platform which is formed with at least one caisson well open at one side of the platform into a position about said one caisson so that the caisson is received within said open caisson well; then placing a jacking head on the upper end of at least said one caisson; and then incrementally exerting a downward pull on at least said one jacking head and an upward pull on the platform to successively elevate the platform on at least said one caisson.

2. A method according to claim 1, wherein the support includes a plurality of caissons and wherein said platform includes a plurality of open caisson wells, said method further comprising the step of positioning said platform with respect to the support so that each of said plurality of caissons is within one of said plurality of caisson wells.

3. The method of quickly elevating a drilling and production platform relative to a plurality of bottomed, upright caissons having the upper end thereof projecting above the water to a height greater than that to which the platform is to be elevated, and wherein the platform has a plurality of open caisson wells, one for each caisson, and is movable into position to receive said caissons, and wherein the platform has a jacking unit for each caisson, and wherein each of the jacking units includes a horizontal jacking head, two pairs of jacking legs, said pairs of jacking legs being pivotally connected at the upper end thereof to the respective opposite ends of the jacking head, and four jacking mechanisms, each pivotally connected at the lower end thereof to the platform and receiving one of the jacking legs, the steps comprising: holding the jacking heads at an elevation higher than the upper end of the caissons; positioning the platform so that a caisson is received in each of the caisson wells; lowering the jacking heads, and sliding the jacking legs downwardly through their associated jacking mechanisms until the jacking heads engage the upper end of the caissons; and then operating the jacking mechanisms of the jacking units to hoist the platform on the caissons, utilizing the upper end of the caissons as load reaction points for the hoisting effort of the jacking units.

4. The method claimed in claim 3, including the further step of locking at least one of the caissons in its associated caisson well prior to operating the jacking mechanisms.

5. Well drilling apparatus comprising: a bottomed, upwardly extending caisson, a platform having a caisson well to receive said caisson therein; a jacking unit mounted upon said platform, said jacking unit including a jacking head and means on said platform for positioning said jacking head above and in engagement with the upper end of said caisson once said bottomed caisson is received in said caisson well, said jacking unit further including a jacking leg and a jacking mechanism connected between said platform and said jacking head and operable to simultaneously exert a downward pulling force on said jacking head and an upward pulling force on said platform to thereby raise said platform upon said bottomed caisson.

6. The well drilling apparatus claimed in claim 5, wherein the jacking head carries a pilot member on its lower side to be received in its associated caisson for axially aligning the jacking head with the axis of the caisson and for maintaining said jacking head in such alignment during a jacking operation.

7. The well drilling apparatus claimed in claim 5, wherein the jacking unit includes at least one jacking leg connected with the opposite ends of the jacking head, said platform having openings extending therethrough to receive the respective jacking legs, each jacking leg extending through a jacking mechanism, each jacking mechanism having two axially spaced sets of wedge-type slips engageable with its associated jacking leg; and means for actuating said sets of slips to energize or retract the same relative to the jacking legs, said slips when energized being freely movable relative to the jacking leg in only an upward direction.

8. The well drilling apparatus claimed in claim 7, including hydraulically operated cylinders and pistons connected between the two sets of slips, said cylinders and pistons being operable to move the sets of slips toward and away from each other along the jacking legs.

9. The well drilling apparatus claimed in claim 8, wherein each set of slips is mounted in a separate holder; and wherein the lower holder constitutes one element of a gimbal joint and is pivotally mounted at diametrically opposite points on a ring constituting another element of the gimbal joint; and wherein means on the platform supports said ring for pivotal movement on an axis at right angles to said diametrically opposite pivot points; and wherein the pivotal axis of said lower slip holder lies in a fore and aft direction.

10. The well drilling apparatus claimed in claim 7, including a frame mounted upon the platform, said frame having upright members disposed on opposite sides of the jacking unit outwardly of the jacking legs; means mounted on said frame and connected with the jacking head for supporting the weight of the jacking head and jacking legs above a caisson prior to the start of the jacking operation, said means being operable to hold the jacking heads clear of the caisson as the platform is being moved into position relative to the caisson, and to thereafter lower the jacking head onto the upper end of the caisson.

11. The well drilling apparatus claimed in claim 10, wherein the means supporting the weight of the jacking head and jacking legs comprises a pair of cables, one end of each of which is connected to the top of the frame, said cables extending downwardly and through pulleys on the jacking head and upwardly and through pulleys mounted at the top of the frame, and then extending downwardly to a dual-drum winch mounted on the platform.

12. The well drilling apparatus claimed in claim 11, wherein a cable is disposed between the frame uprights and its associated jacking unit on opposite sides of said jacking unit for stabilizing the jacking unit relative to the platform, said cables being connected with the respective ends of the jacking head and arranged to steady the jacking unit while permitting movement of the frame relative to the caisson in response to movement of the platform relative to the caisson under wind and wave action.

13. The well drilling apparatus claimed in claim 12, wherein the cables are anchored at their upper end to the upper portion of the frame and extend around pulley means mounted on the frame uprights and on opposite ends of the jacking head, each of said cables having the lower end thereof connected with a snubbing device to maintain tension in said cables.

14. The well drilling apparatus claimed in claim 13, wherein the pulleys mounted on the frame uprights are carried by a trolley freely movable along the frame uprights to accommodate relative movement of the jacking head and platform as the platform is being elevated on the caissons.

15. Well drilling apparatus, comprising: a plurality of bottomed, upwardly extending caissons spaced from one another, a platform having a plurality of spaced apart caisson wells, said wells each having an open end to receive one of said similarly spaced caissons; a plurality of jacking units mounted upon said platform, each jacking unit including a jacking head and means on said platform for positioning its associated jacking head above and in engagment with the upper end of one of said caissons once said one caisson is received in its associated caisson well, each jacking unit also including means straddling each caisson well and connected between said platform and each of said jacking heads and operable to simultaneously exert a downward pulling force on said jacking head and an upward pulling force on said platform to thereby raise said platform upon said bottomed caissons.

16. The method of lifting a buoyant off-shore platform on a pre-installed support, by means of a fail-safe jacking mechanism attached to said platform and positioned on an elongated jacking leg connected at its upper end to said support, under conditions in which said platform is subject to wave action, said jacking mechanism including upper and lower housings having therein upper and lower sets of wedge-shaped, self-energizing slips, respectively, arranged to sequentially grip and release said elongated jacking leg to provide a ratchet-like action, said upper and lower housings being connected together by jacking means disposed therebetween and said lower housing being attached to said platform, and wherein said method comprises the steps of: actuating said jacking means to apply jacking forces between said housings for sequentially moving said housings toward and away from each other, and upwardly relative to said jacking leg to cause said sets of slips to selectively grip or release said jacking leg; moving the upper housing upwardly away from the lower housing to release the upper set of slips while maintaining the lower set of slips energized in a gripping, fail-safe condition; next moving said lower housing upwardly toward said upper housing to cause the upper set of slips to grip said jacking leg to establish a fail-safe condition and to lift said platform relative to said jacking leg, and to release the grip of the lower set of slips, whereby any effective wave action occurring during said lifting of said platform will assist in raising said platform, and said upper set of slips will hold said platform at the position to which it has been raised by said wave action and will continue to raise said platform so long as said lower housing is being moved upwardly toward said upper housing, and whereby the maintenance of said slips in a fail-safe condition prevents accidental dropping of said platform.

17. The method of quickly elevating an off-shore platform relative to at least one bottomed, upright support, said method comprising the steps of positioning an off-shore platform having a caisson well open at one side of the platform so that the support is received within said open caisson well, pivotally connecting the lower end of at least one jacking mechanism with the platform, pivotally connecting one end of at least one rigid jacking leg at the upper and of said support and extending said jacking leg alongside said support but unconnected thereto so that the other end of said jacking leg is moveable with respect to said support, positioning said jacking mechanism along said rigid jacking leg and operating said jacking mechanism to elevate the platform using the upper end portion of said one support as a load reaction point for the hoisting effort of the jacking mechanism, said pivotal connection accommodating the free movement of the platform relative to said support in response to wind and wave action.

18. The method claimed in claim 17 wherein the upright support comprises an assembly of a single caisson and several legs angularly connected thereto, and including the further step of: anchoring the legs on the sea bottom prior to elevating the platform on the caisson.

19. The method claimed in claim 17 wherein the jacking leg is pivotally connected to a jacking head, said method further including the steps of: positioning the jacking head above the support and lowering the jacking head onto the upper end of the support prior to operating the jacking mechanism.

20. The method claimed in claim 19, including the further step of: locking the support within the well prior to operating the jacking mechanism.

21. The method claimed in claim 17, wherein the support comprises an assembly of three caissons arranged as a tripod, and including the further steps of: pivotally connecting the lower end of at least three jacking mechanisms with the platform; pivotally connecting one end of at least one rigid jacking leg at the upper end of each caisson and extending each leg alongside its associated caisson but unconnected thereto so that the other end of each jacking leg is moveable with respect to said support, positioning one of said jacking mechanisms along each jacking leg and operating the jacking mechanisms to elevate the platform on the caissons.

22. The method claimed in claim 21, further including a jacking head for each caisson to which a jacking leg is pivotally connected and wherein the caissons are received in separate open caisson wells in the platform, said method further including the step of positioning each jacking head on the upper end of its associated caisson prior to operating the jacking mechanisms.

23. The method claimed in claim 21, further including a jacking head for each caisson and at least two jacking legs pivotally connected to each jacking head and wherein the caissons are received in separate open caisson wells in the platform, said method further including the steps of: arranging the jacking legs in straddling relation to their associated caissons with each jacking leg extending through a jacking mechanism, positioning at least one of said jacking heads on the upper end of its associated caisson and operating the jacking mechanisms associated with said one jacking head to hoist the platform on the caissons.

24. Apparatus comprising an off-shore platform having a caisson well open at one side of the platform; a bottomed, upright caisson in said well; and a jacking unit mounted upon said platform having a jacking leg connected at its upper end with the upper end of said caisson, said jacking unit further including a jacking mechanism connected at its lower end with said platform adjacent said caisson well and positioned on said jacking leg, said jacking mechanism having first and second sets of wedge-type, self-energizing gripping elements surrounding and engaging substantially the entire circumference of said jacking leg and means positioned between said sets of slips to alternately move said sets of slips upwardly and thereby alternately cause release of gripping by each of said sets of slips whereby said jacking mechanism moves said platform along said jacking leg to raise said platform relative to said caisson.

25. The apparatus claimed in claim 24, wherein the jacking unit includes a jacking head mounted on the caisson, and wherein the upper end of the jacking leg is connected to the jacking head, and wherein the jacking head includes a pilot portion telescoping with the upper end of the caisson, to maintain the jacking head in axial alignment with the caisson.

26. The apparatus claimed in claim 25, wherein the pilot portion telescopes with the caisson sufficiently to transmit a cantilever load from the jacking leg to the caisson.

27. The well drilling apparatus claimed in claim 25, wherein the platform has three open caisson wells, in combination with a tripod platform support having three upright caissons, each of said caissons being received in an open caisson well in the platform and disposed beneath a jacking head; and at least one gate mounted on the platform and closing one of said caisson wells for locking the associated caisson therein.

28. Apparatus comprising a support, an elongated jacking leg connected to said support, a buoyant offshore platform subject to wave action and a jacking mechanism positioned on said jacking leg and connected to said platform, said jacking mechanism including first and second gripping means for gripping said jacking leg, each of said gripping means including a set of wedge-shaped, spring-actuated, self energizing slips mounted in a correspondingly shaped slip holder, said slip holders each being configured and oriented such that the slips of one set automatically grip said jacking leg when a downward force is applied to the slip holder of said one set and automatically release from said jacking leg against said spring actuation when an upward force is applied to said one slip holder, said jacking mechanism further including jacking means positioned between said first and second gripping means for alternately applying jacking forces between said gripping means to move said gripping means toward and away from each other for raising the platform, wherein upwardly directed forces applied to said platform by wave action temporarily release the engaged gripping means against said spring actuation and move same and said platform upwardly along said jacking leg, and wherein immediately upon termination of the application of jacking and/or wave action forces, the associated spring-actuated selfenergizing slips grip said jacking leg to retain the platform at the position to which it has been raised.

29. Apparatus comprising at least one bottomed, upright support, an offshore platform formed with a caisson well open at one side of the platform for receiving said support therein, at least one rigid jacking leg pivotally connected at one end to the upper end of said support, said jacking leg extending alongside said support but unconnected thereto so that its other end is movable with respect to said support, and at least one jacking mechanism pivotally connected to said platform, said jacking mechanism being positioned along said rigid jacking leg, wherein the upper end portion of said support is a load reaction point for the hoisting effort of the jacking mechanism and wherein said pivotally connected jacking leg and jacking mechanism cooperate to accommodate the free movement of the platform relative to said support in response to wind and wave action.

* * * * *

UNITED STATES PATENT AND TRADEMARK OFFICE

CERTIFICATE OF CORRECTION

PATENT NO. : 4,041,711

DATED : August 16, 1977

INVENTOR(S) : JOSEPH E. LUCAS

It is certified that error appears in the above-identified patent and that said Letters Patent are hereby corrected as shown below:

Column 2, line 21, "must" should read --much--;

Column 5, line 55, "porvide" should read --provide--;

Column 7, line 59, "enlaarged" should read --enlarged--;

Column 8, line 1, "gradually" should read --and gradually--;

Column 10,line 56, "furthr" should read --further--;

Column 11,line 5, "te" should read --the--;

Column 11,line 15, "slipactuating" should read --slip-actuating--;

Column 13,line 42, "holders 192" should read --holders 194--;

Column 15,line 36, "EAch" should read --Each--;

UNITED STATES PATENT AND TRADEMARK OFFICE

CERTIFICATE OF CORRECTION

PATENT NO. : 4,041,711

DATED : August 16, 1977

INVENTOR(S) : JOSEPH E. LUCAS

It is certified that error appears in the above-identified patent and that said Letters Patent are hereby corrected as shown below:

Claim 17, Column 18, line 62, "and" (first occurrence) should read --end--;

Claim 28, Column 20, line 48, "selfenergizing" should read --self-energizing--.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*